US008118308B2

(12) United States Patent
Wiseman

(10) Patent No.: US 8,118,308 B2
(45) Date of Patent: Feb. 21, 2012

(54) BOARD GAME

(76) Inventor: John Wiseman, Dallas, TX (US)

( * ) Notice: Subject to any disclaimer, the term of this patent is extended or adjusted under 35 U.S.C. 154(b) by 0 days.

(21) Appl. No.: 12/707,593

(22) Filed: Feb. 17, 2010

(65) Prior Publication Data

US 2011/0198806 A1 Aug. 18, 2011

(51) Int. Cl.
*A63F 3/00* (2006.01)

(52) U.S. Cl. ..... 273/260; 273/290

(58) Field of Classification Search ..... 273/260, 273/261, 262, 290

See application file for complete search history.

(56) References Cited

U.S. PATENT DOCUMENTS

| | | | | |
|---|---|---|---|---|
| 1,666,953 | A * | 4/1928 | Tuttle et al. | 273/262 |
| 5,011,159 | A * | 4/1991 | Fortunato et al. | 273/260 |
| 2007/0040330 | A1* | 2/2007 | Robinson | 273/243 |
| 2008/0116636 | A1* | 5/2008 | McCray | 273/260 |

* cited by examiner

*Primary Examiner* — Vishu K. Mendiratta

(57) ABSTRACT

A board game and methods for playing the same are disclosed. The board game can include a playing surface having a plurality of playing spaces, and a plurality of playing pieces that comprise at least first and second player playing pieces, wherein each playing piece is assigned a numerical value, and wherein the numerical value corresponds to: a movement value, wherein the movement value corresponds to the number of playing spaces that each playing piece can move on the playing surface; and a challenge value, wherein the challenge value corresponds to a challenge between a first player playing piece and a second player playing piece, wherein the second player playing piece can be removed from the playing surface when the first player playing piece has an equal or greater challenge value then the second player playing piece and when the first player playing piece is moved into the second player playing piece's playing space.

4 Claims, 21 Drawing Sheets

BOARD GAME

CROSS REFERENCE TO RELATED APPLICATIONS

None at this time.

FIELD OF THE INVENTION

The present invention relates generally to a board game, which, in non-limiting embodiments, can provide entertainment and educational value for both children and adults.

SUMMARY OF THE INVENTION

The present board game provides both adults and children with an entertaining game that can be strategic and educational.

In one non-limiting embodiment, there is disclosed a board game comprising a playing surface having a plurality of playing spaces; and a plurality of playing pieces that are separated into at least first and second player playing pieces, wherein each playing piece is assigned a numerical value, and wherein the numerical value corresponds to: a movement value, wherein the movement value corresponds to the number of playing spaces that each playing piece can move on the playing surface; and a challenge value, wherein the challenge value corresponds to a challenge between a first player playing piece and a second player playing piece, wherein the second player playing piece can be removed from the playing surface when the first player playing piece has a greater than or equal to challenge value when compared with the second player playing piece's challenge value and when the first player playing piece is moved into the second player playing piece's playing space. In one aspect, at least two, three, four, five, six, seven, or eight or more players can play the game. Each of the additional players can have their own playing pieces. The numerical value can be displayed on the plurality of playing pieces. By way of example, the numerical value can be displayed on or embodied in the top, bottom, and/or sides of the playing pieces. The numerical value can be represented by an integer (e.g., 1, 2, 3, 4, 5, 6, 7, 8, 9, 10, etc.) or any forms, symbols, designs, marks, or other representations thereof. For instance, and by way of example only, a symbol such as a triangle can represent a value of 1, a square can represent a value of 2, etc. The numerical value can be displayed on or embodied in to the top, bottom, and/or sides of the playing pieces via a self adhesive sticker. In one aspect, the shape of the playing piece can be formed to correspond to a given numerical value (e.g., a playing piece with a numerical value of three can be shaped in a manner that resembles the numerical number 3). Also, the shape of the playing piece can be formed to correspond to a given shape that is illustrative of a particular numerical value (e.g., the shape of a half-moon could represent the numerical number 3). The plurality of playing pieces can move in a wide variety of directions along the playing spaces up to their respective assigned numerical values. In one aspect, the pieces can move horizontally, vertically, and/or diagonally along the playing spaces up to their respective assigned numerical values. In some instances, a challenge between two playing pieces can be made by diagonally moving into a playing space that is occupied by an opponents playing piece. In certain embodiments, the movement of the playing pieces can be limited to horizontal and/or vertical directions to unoccupied playing spaces and diagonal directions for purposes of a challenge. In one aspect, the plurality of playing pieces can move only one playing space in a diagonal direction and only for the purposes of a challenge. In one embodiment, a first player playing piece can move along a chain of playing pieces, wherein the chain comprises at least two other first player playing pieces that occupy adjacent playing spaces. A playing piece can move along any point of the chain. In one aspect, a playing piece can be moved along or adjacent to any point on the chain by moving to: (i) an unoccupied playing space that is adjacent to the chain or any point on the chain (e.g., in instances where a player desires to create a stack); (ii) a playing space that is adjacent to the chain and occupied by another first player playing piece; or (iii) a playing space that is adjacent to the chain and occupied by a second player playing piece. The challenge value of the chain can be the combined value of all of the playing pieces that comprise the chain. In certain embodiments, the plurality of playing pieces are configured so as to allow the playing pieces to be stacked on top of one another. The movement value of the stacked playing pieces can be the assigned numerical value of the top piece of the stack. The challenge value of the stacked playing pieces can be the combined assigned numerical value of all of the playing pieces in the stack. A stacked set of playing pieces can also be un-stacked by moving any piece in the stack to a playing space. In some embodiments, the top, middle, and/or bottom piece of a stack can be removed from the stack. The stack can include at least two, three, four, five, six, seven, eight, nine, ten, or more playing pieces. The number of playing pieces for each player can vary (e.g., each player can start with two, three, four, five, six, seven, eight, nine, ten, eleven, twelve, thirteen, fourteen, fifteen, sixteen, seventeen, eighteen, nineteen, or twenty, or more playing pieces with each piece having any given assigned numerical value (e.g., numerical value of 1, 2, 3, 4, 5, 6, 7, 8, 9, 10, 11, 12, 13, 14, 15, 16, 17, 18, 19, 20, or more). In one aspect, the first player playing pieces comprise: (i) a first playing piece that includes an assigned numerical value of one; (ii) a second playing piece that includes an assigned numerical value of two; (iii) a third playing piece that includes an assigned numerical value of three; (iv) a fourth playing piece that includes an assigned numerical value of four; (v) a fifth playing piece that includes an assigned numerical value of five; and (vi) a sixth playing piece that includes a numerical value of six. The second (or third, or fourth, or fifth, or sixth, or seventh, or eight, etc.) player playing pieces can include: (i) a first playing piece that includes an assigned numerical value of one; (ii) a second playing piece that includes an assigned numerical value of two; (iii) a third playing piece that includes an assigned numerical value of three; (iv) a fourth playing piece that includes an assigned numerical value of four; (v) a fifth playing piece that includes an assigned numerical value of five; and (vi) a sixth playing piece that includes a numerical value of six. In one aspect, the first player playing pieces can include: (i) four playing pieces having an assigned numerical value of one; (ii) two playing pieces having an assigned numerical value of two; (iii) two playing pieces having an assigned numerical value of three; (iv) two playing pieces having an assigned numerical value of four; (v) one playing pieces having an assigned numerical value of five; and (vi) one playing pieces having an assigned numerical value of six; and the second (or third, or fourth, or fifth, or sixth, or seventh, or eight, etc.) player playing pieces further comprise: (i) four playing pieces having an assigned numerical value of one; (ii) two playing pieces having an assigned numerical value of two; (iii) two playing pieces having an assigned numerical value of three; (iv) two playing pieces having an assigned numerical value of four; (v) one playing pieces having an assigned numerical value of five; and (vi) one playing pieces having an assigned numerical value of six. In another embodiment, only one and two value pieces can recapture. The playing surface of the board game can include a first player recapture zone which allows for first player playing pieces that have been removed from the playing surface due to a previous challenge to be added back to the playing surface when a first player playing piece is moved into the first player recapture zone. The playing surface can also include a second (or third, or fourth, or fifth, or sixth, or seventh, or eight, etc.) player recapture zone which allows for second (or third, or fourth, or fifth, or sixth, or seventh, or eight, etc.) player playing pieces that have been removed from the playing surface due to a previous challenge to be added back to the playing surface when a second (or third, or fourth, or fifth, or sixth, or seventh, or eight, etc.) player playing piece is moved into the second player recapture zone. The recapture zone can be positioned in a variety of places on the playing surface. In one aspect, the plurality of playing spaces are organized into rows and columns. In some aspects, there can be two rows and two columns, three rows and three columns, four rows and four columns, five rows and five columns, six rows and six columns, seven rows and seven columns, eight rows and eight columns, nine rows and nine columns, ten rows and ten columns, eleven rows and eleven columns, twelve rows and twelve columns, thirteen rows and thirteen columns, fourteen rows and fourteen columns, fifteen rows and fifteen columns, sixteen rows and sixteen columns, seventeen rows and seventeen columns, eighteen rows and eighteen columns, nineteen rows and nineteen columns, twenty rows and twenty columns, etc. In other aspects, there can be more rows than columns or more columns than rows (e.g., two rows and three columns, three rows and four columns, four rows and five columns, five rows and seven columns, six rows and eight columns, seven rows and nine columns, eight rows and ten columns, nine rows and twelve columns, ten rows and thirteen columns, eleven rows and fourteen columns, twelve rows and fifteen columns, thirteen rows and seventeen columns, fourteen rows and eighteen columns, fifteen rows and nineteen columns, sixteen rows and twenty columns, etc.). The shape and/or configuration and/or arrangement of the playing surface can vary. By way of example, it could be shaped as a square, rectangle, circle, oval, triangle, pentagon, hexagon, heptagon, octagon, nonagon, decagon, star (e.g., four, five, six, seven, eight, or more pointed star). In another embodiment, the configuration of the board can take on other configurations (e.g., symmetrical and asymmetrical configurations of playing spaces). In certain aspects, players playing the board game take alternating moves. In one instance, an object of the game is for a player to capture all of the pieces of another player's playing pieces.

Also disclosed is a method of playing the board game described throughout this specification. In one aspect, the board game can be played by a multitude of players (e.g., two, three, four, five, six, seven, eight, nine, ten, etc.). The method can include: providing a game board having a plurality of playing spaces; providing a plurality of playing pieces to the players, wherein the playing pieces are separated into at least first and second player playing pieces, wherein each playing piece is assigned a numerical value, and wherein the numerical value corresponds to: a movement value, wherein the movement value corresponds to the number of playing spaces that each playing piece can move on the playing surface; and a challenge value, wherein the challenge value corresponds to a challenge between a first player playing piece and a second player playing piece, wherein the second player playing piece can be removed from the playing surface when the first player playing piece has a greater or equal challenge value then the second player playing piece and when the first player playing piece is moved into the second player playing piece's playing space, wherein the plurality of players take alternating turns by moving one of their respective playing pieces on the game board up to the movement value of the playing piece. In one instance, an object of the game is for a player to capture all of the pieces of another player's playing pieces.

In certain embodiments, the board game disclosed throughout the specification can be played on a computer. As used herein, "computer" should be interpreted broadly as is not limited to traditional personal computers or laptops. For instance, the term encompasses any computing device such as, but not limited to, personal digital assistants, portable e-mail devices, other handheld devices, pagers, cell phones, smart phones, or the like. The board games can be stored or accessed on a computer readable medium. Computer readable medium includes, but is no way limited to, media such as any memory device, a hard drive, a CD, a DVD, a flash device, a floppy disk, a tape, or a file resident on a server or other storage. In certain aspects, a first player can be a human while the second player can be a computer or computer program. Also, the board game can be played on-line (e.g., through an interne connection) via a computer.

The game board, playing pieces, corresponding methods of use, etc. can "comprise," "consist essentially of," or "consist of" any of the elements disclosed throughout the specification.

It is contemplated that any embodiment discussed in this specification can be implemented with respect to any method, apparatus, game board, game pieces, etc. of the invention, and vice versa.

The use of the word "a" or "an" when used in conjunction with the term "comprising" in the claims and/or the specification may mean "one," but it is also consistent with the meaning of "one or more," "at least one," and "one or more than one."

The use of the term "or" in the claims is used to mean "and/or" unless explicitly indicated to refer to alternatives only or the alternatives are mutually exclusive, although the disclosure supports a definition that refers to only alternatives and "and/or."

As used in this specification and claim(s), the words "comprising" (and any form of comprising, such as "comprise" and "comprises"), "having" (and any form of having, such as "have" and "has"), "including" (and any form of including, such as "includes" and "include") or "containing" (and any form of containing, such as "contains" and "contain") are inclusive or open-ended and do not exclude additional, unrecited elements or method steps.

Other objects, features and advantages of the present invention will become apparent from the following detailed description. It should be understood, however, that the detailed description and the examples, while indicating specific embodiments of the invention, are given by way of illustration only. Additionally, it is contemplated that changes and modifications within the spirit and scope of the invention will become apparent to those skilled in the art from this detailed description.

BRIEF DESCRIPTION OF THE DRAWINGS

The following drawings form part of the present specification and are included to demonstrate non-limiting aspects of the present invention. The invention may be better understood by reference to one or more of these drawings in combination with the description of illustrative embodiments presented here. The drawings are not to scale, and certain distances or spacings may be exaggerated to provide clarity. The drawings are examples only. They do not limit the claims.

DESCRIPTION OF ILLUSTRATIVE EMBODIMENTS

The following sections provides certain non-limiting embodiments of the board game. Such embodiments include non-limiting details about the playing surface, playing pieces, starting positions of the playing pieces, etc. One skilled in the relevant art, however, will recognize that such embodiments may be practiced with or without one or more of these non-limiting details.

A. Playing Surface

Figure 1A:
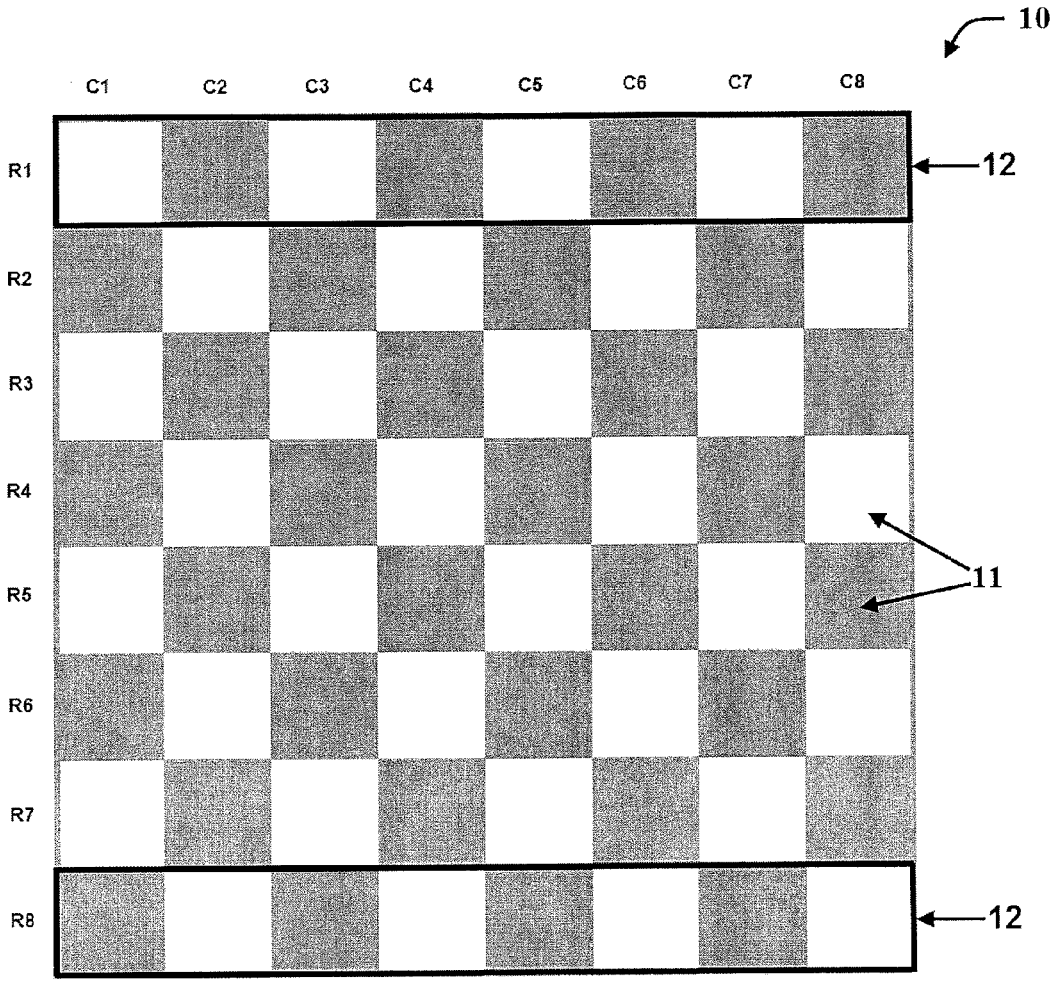
FIGS. 1A-D illustrates playing surfaces with playing spaces have a variety of different shaped and positioned recapture zones.
Figure 1B:
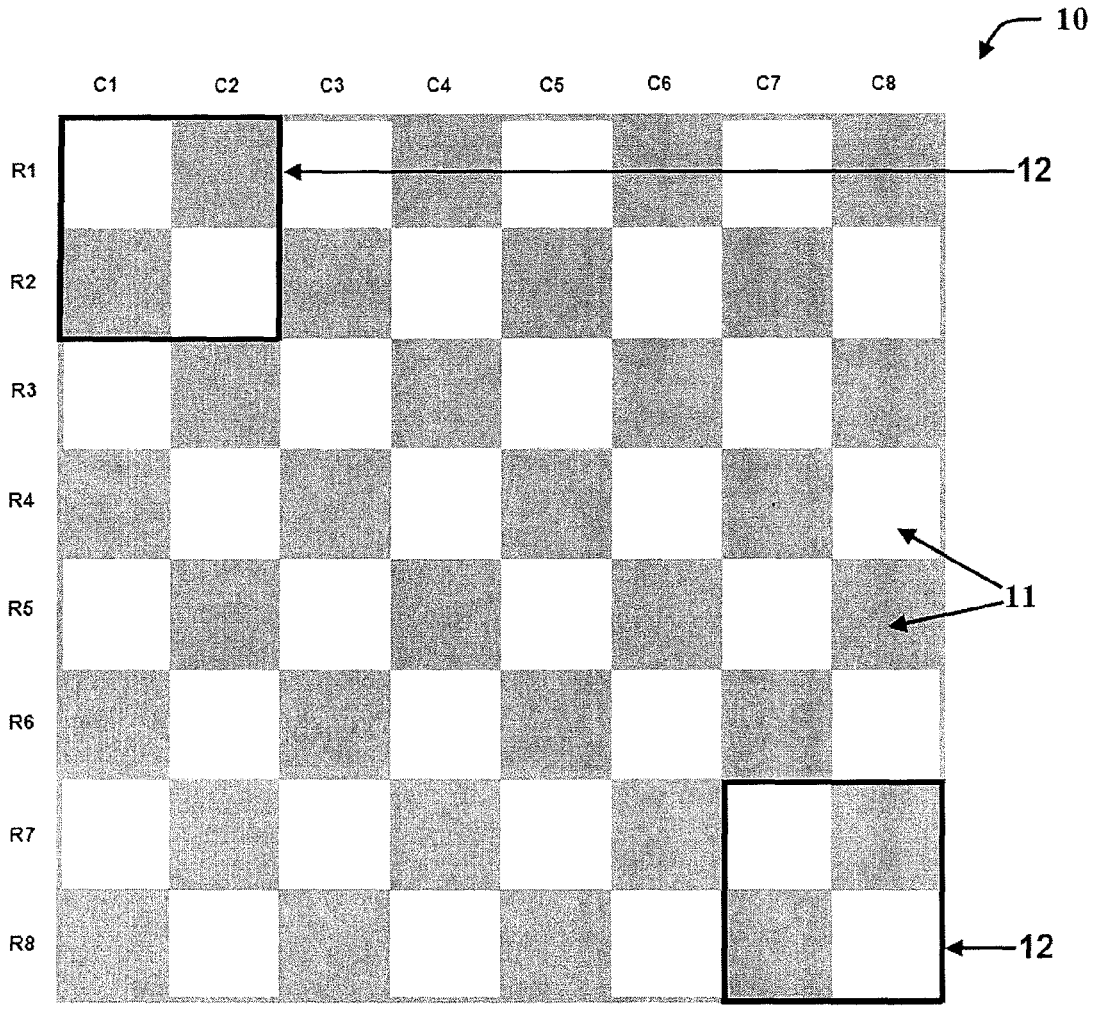
Figure 1C:
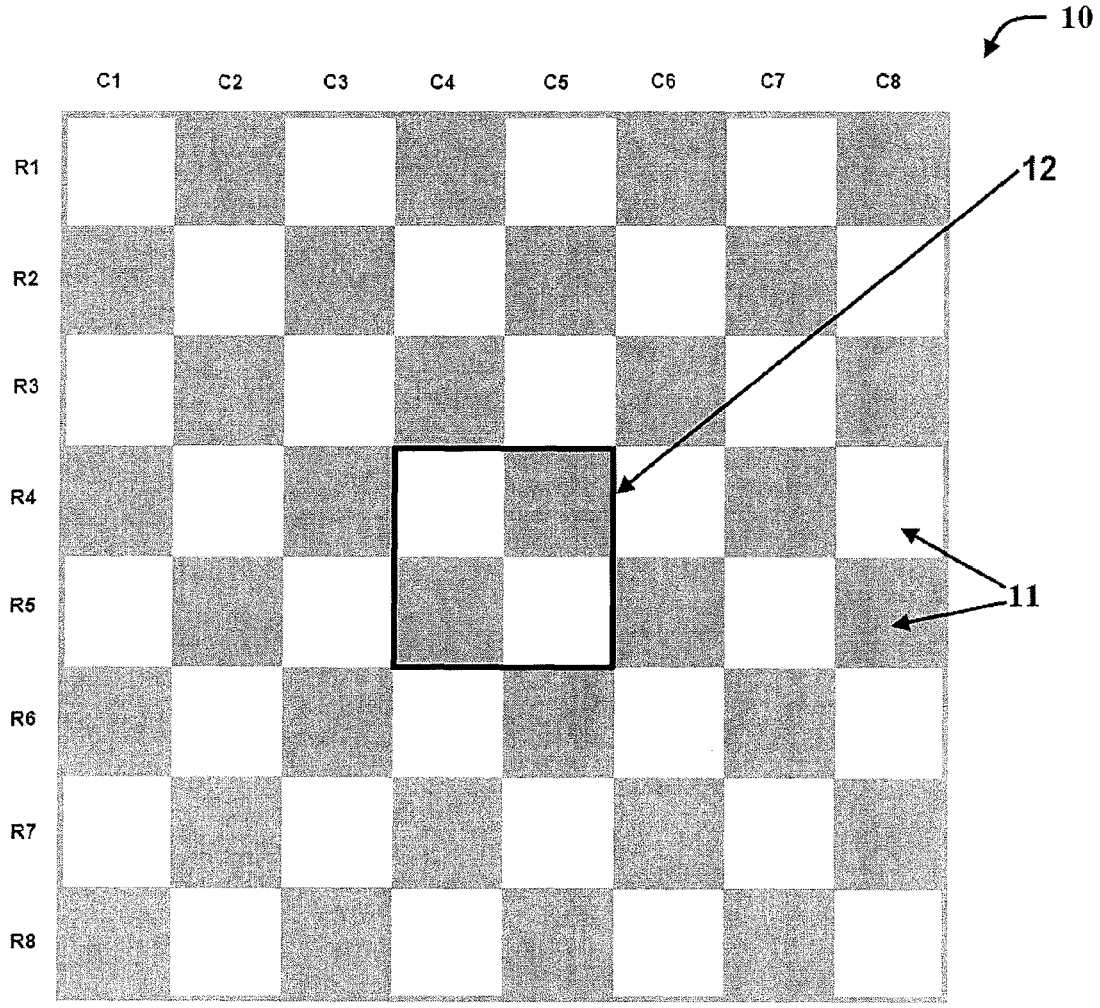
Figure 1D:
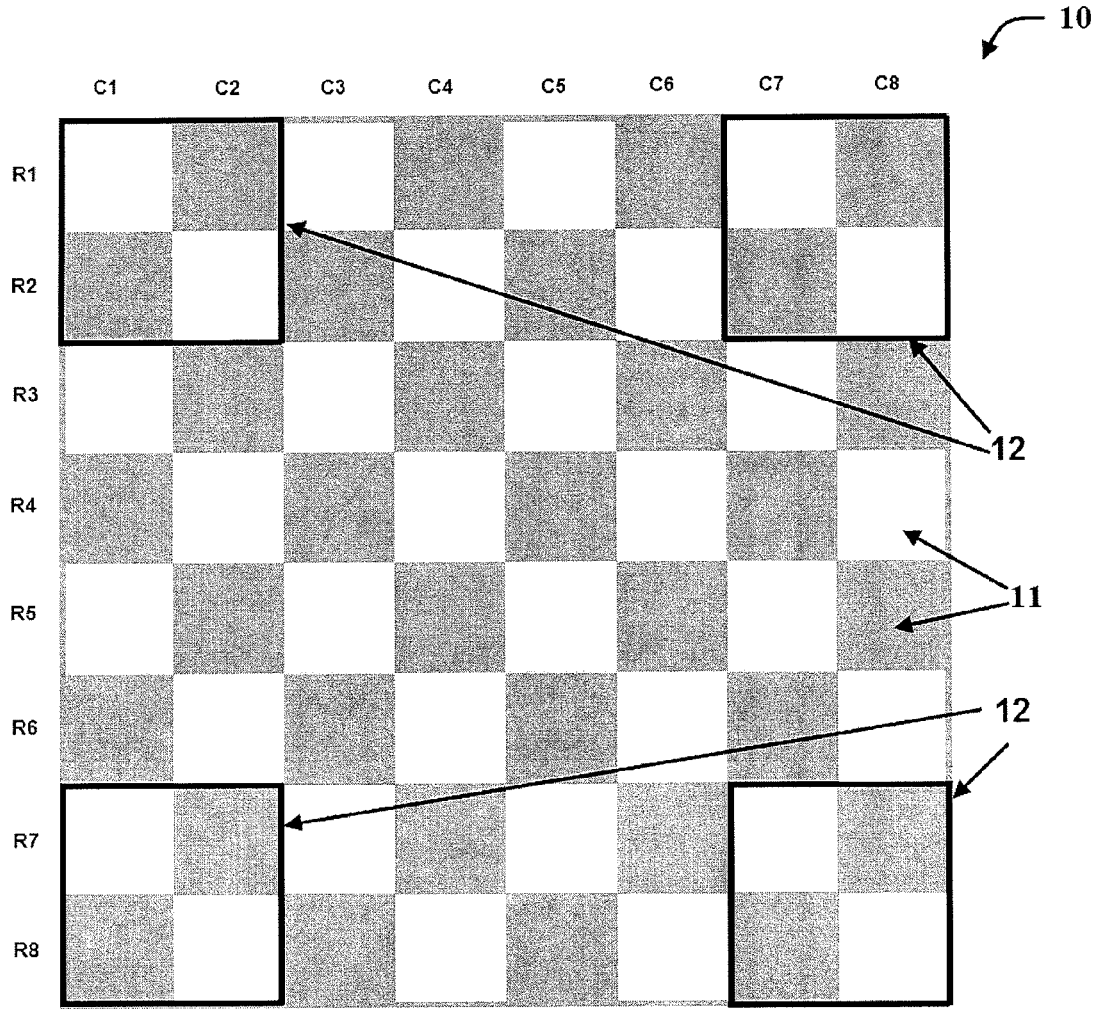

Referring to FIG. 1A, the playing surface 10 is shaped as a square. Other shapes can also be used, examples of which include rectangle, circle, oval, triangle, pentagon, hexagon, heptagon, octagon, nonagon, decagon, star (e.g., four, five, six, seven, eight, or more pointed star). The playing surface 10 includes a plurality of playing spaces 11, which are organized into eight rows R1-R8 and eight columns C1-C8. The rows and columns can be varied to include fewer or more rows and columns. Further, their can be more columns than rows or more rows than columns. The playing surface 10 also includes two recapture zones 12. The first recapture zone 12 occupies R1 and C1-C8. The second recapture zone occupies R8 and C1-C8. The first recapture zone 12 can be used for a first player, and the second recapture zone 12 can be used for a second player. Alternatively, the recapture zones 12 can be used by all of the players. FIGS. 1B-1D illustrate that the recapture zones 12 can have varying shapes and positions on the playing surface 10. For instance, FIG. 1B illustrates two recapture zones, where a first zone 12 occupies R1-R2 and C1-C2, and a second zone 12 occupies R7-R8 and C7-C8. FIG. 1C includes a singe recapture zone 12, which can be used by all of the players. FIG. 1D illustrates four recapture zones 12, where a first zone 12 occupies R1-R2 and C1-C2, a second zone 12 occupies R1-R2 and C7-C8, a third zone 12 occupies R7-R8 and C1-C2, and a fourth zone occupies R7-R8 and C7-C8. As illustrated in each of FIGS. 1A-1D, the recapture zones 12 can be marked on the playing surface, which in the present case are illustrated with heavily weighted lines. However, it is contemplated that any type of marking/illustration can be used to designate a recapture zone 12 (e.g., broken lines, coloring, shapes, pictures, indicia, markings, etc.). In another embodiment, the configuration of the board can take on other configurations (e.g., symmetrical and asymmetrical configurations of playing spaces).

The playing surface 10 can be made of plastic, cardboard, wood, concrete, granite, ivory, etc. Further, the playing surface can be displayed on a computer, can be stored or accessed in/from a computer readable medium, etc.

B. Playing Pieces

Figure 2A:
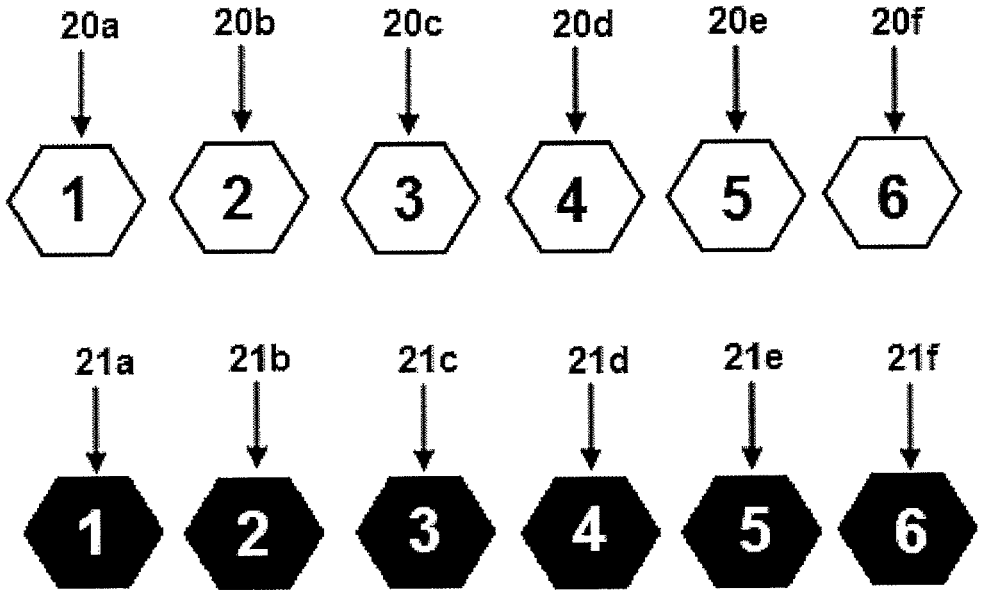
FIGS. 2A-B illustrates playing pieces having a variety of different shapes.

Referring to FIG. 2A, the playing pieces 20*a*-20*f* can be used for a first player. Playing pieces 21*a*-21*f* can be used for a second player. In this regard, the pieces 20*a*-20*f* are illustrated as having a white color (any color can be used), while playing pieces 21*a*-21*f* are illustrated as having a black color (again, any color can be used). Playing pieces 20*a*-20*f* and 21*a*-21*f* have assigned numerical values ranging from 1-6, respectively, which can correspond to both the movement and challenge value of these pieces. In FIG. 2A, the numerical values of the playing pieces 20*a*-20*f* and 21*a*-21*f* are illustrated on the surface of the pieces. These values can be etched, painted, affixed (e.g., adhesive sticker), etc., onto any surface (e.g., top, bottom, sides) of the pieces 20*a*-20*f* and 21*a*-21*f*.

Figure 2B:
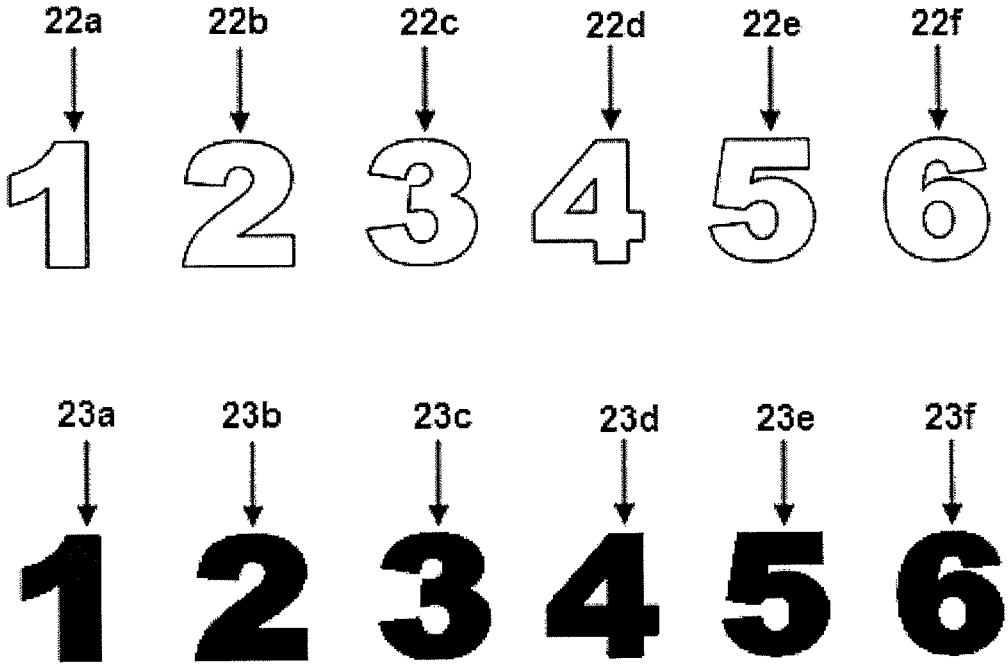

Alternatively, the playing pieces can be formed to represent their respective numerical values. This concepts is illustrated in FIG. 2B. For instance, playing pieces 22*a* and 23*a* are shaped like a 1, 22*b* and 23*b*, are shaped like a 2, 22*c* and 23*c* are shaped like a 3, 22*d* and 23*d* are shaped like a 4, 22*e* and 23*e* are shaped like a 5, and 22*f* and 23*f* are shaped like a 6. respectively.

The playing pieces 20*a*-23*f* can be made of plastic, cardboard, wood, concrete, granite, ivory, etc. In other aspects, the playing pieces 20*a*-23*f* can be displayed on a computer, can be stored or accessed on/from a computer readable medium.

C. Initial Game Set-Up

Figure 3:
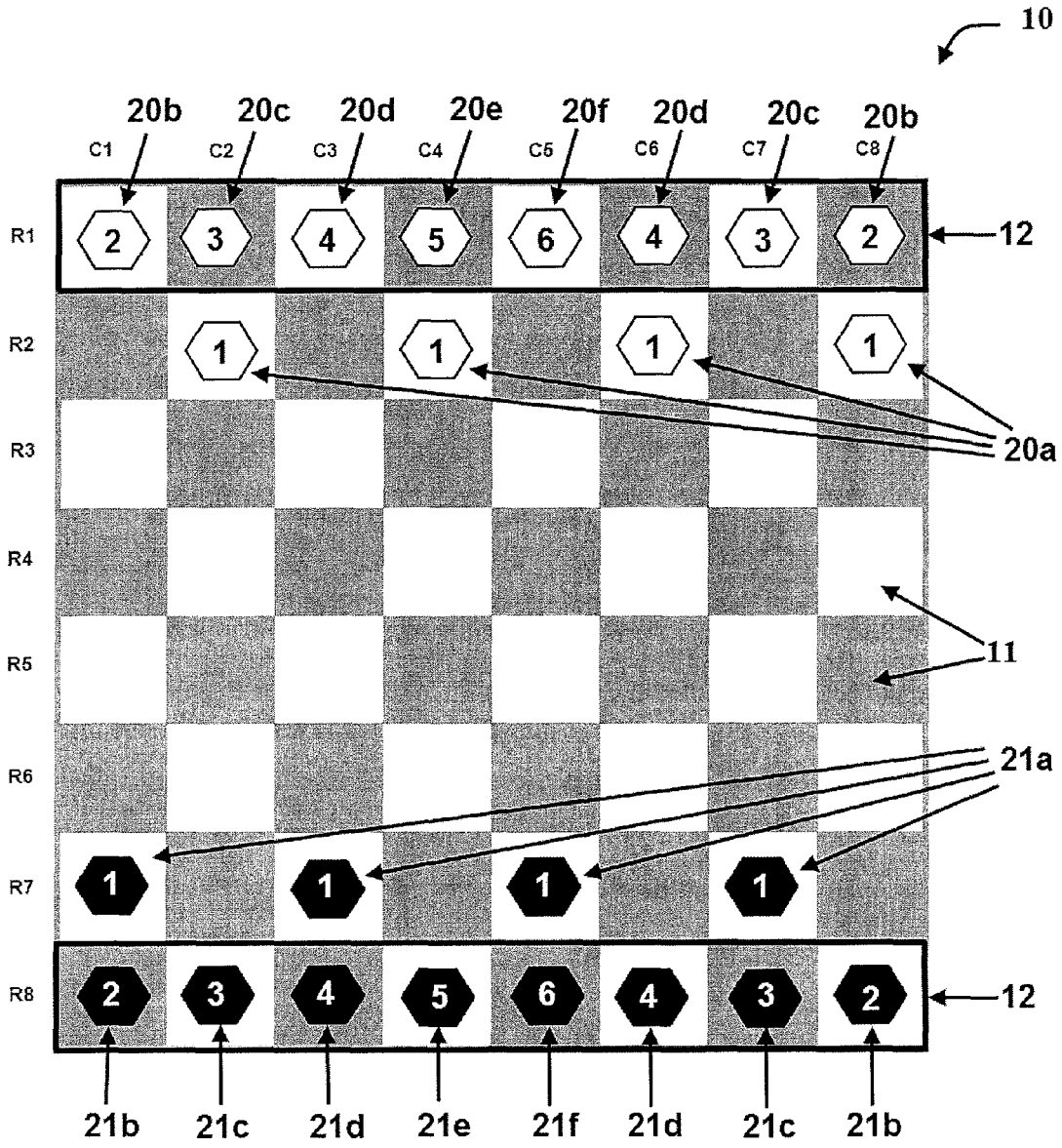
FIG. 3 illustrates an initial game set-up between two players.

A variety of initial game set-ups can be used. FIG. 3 represents an example of one non-limiting set up. Playing pieces 20*a*-20*f* can represent the pieces used for a first player, while pieces 21*a*-22*f* can represent the pieces used for a second player. In this embodiment, each player has four pieces having a numerical value of 1 (20*a* and 21*a*), two pieces having a numerical value of two (20*b* and 21*b*), two pieces having a numerical value of three (20*c* and 21*c*), two pieces having a numerical value of four (20*d* and 21*d*), one piece having a numerical value of five (20*e* and 21*e*), and one piece having a numerical value of six (20*f* and 211).

Playing pieces 20*a* are positioned on the playing surface 10 at R2-C2, R2-C4, R2-C6, and R2-C8 respectively. Playing pieces 20*b* are positioned on the playing surface 10 at R1-C1 and R1-C8, respectively. Playing pieces 20*c* are positioned on the playing surface 10 at R1-C2 and R1-C7, respectively. Playing pieces 20*d* are positioned on the playing surface 10 at R1-C3 and R1-C6, respectively. Playing piece 20*e* is positioned on the playing surface 10 at R1-C4. Playing piece 20*f* is positioned on the playing surface at R1-C5. Playing pieces 21*a* are positioned on the playing surface 10 at R7-C1, R7-C3, R7-C5, and R7-C7 respectively. Playing pieces 21*b* are positioned on the playing surface 10 at R8-C1 and R8-C8, respectively. Playing pieces 21*c* are positioned on the playing surface 10 at R8-C2 and R8-C7, respectively. Playing pieces 21*d* are positioned on the playing surface 10 at R8-C3 and R1-C6, respectively. Playing piece 21*e* is positioned on the playing surface 10 at R8-C4. Playing piece 21*f* is positioned on the playing surface at R8-C5. The initial position of the playing pieces 20*a*-21*f* can be varied in any manner. Also, the number of playing pieces (e.g., more or less) and the corresponding numerical values of the pieces can be varied in any manner (e.g., higher or lower).

D. Movement of Playing Pieces and Attack

FIG. 4 illustrates a playing piece 21*c* having an assigned numerical value of 3 challenging a second playing piece 20*b* having an assigned numerical value of 2. The dashed arrows represent playing piece 21*c* moving on the playing surface 10. Each dashed arrow represents a move from one playing space 11 to the next. For instance, and because playing piece 21*c* has an assigned numerical value of 3, it can move up to three playing spaces 11. In this instance, it moves from R6-C4 to R5-C4 and from R5-C4 to R4-C4 in a vertical direction, for a total of two playing spaces. It then moves from R4-C4 to R3-C5 in a diagonal direction, thereby exhausting its movement value for this turn. By moving from R4-C4 to R3-C5 it moves into a playing space 11 occupied by playing piece 20*b*, which provokes a challenge between these pieces. Playing piece 21*c* wins the challenge due to it having a greater challenge value (3) when compared with playing piece 20*b*'s challenge value (2). In instances where two playing pieces have the same challenge value, then both pieces could be removed from the playing surface 10. In an alternative embodiment, and in instances where two playing pieces have the same challenge value, then the piece provoking the challenge could win; in this regard, a tie goes to the challenger. In a further alternative embodiment, and still in instances where two opposing playing pieces have the same challenge value, then the piece provoking the challenge could lose; in this regard, a tie goes to the challengee. Further, if playing piece 21*c* had a lesser challenge value then 20*b*, then 20*b* could win the challenge, which would result in 21*c* being removed from the playing surface 10.

Any playing piece that is removed from the playing surface 10 can be re-captured and placed back onto the playing surface 10. Staying with FIG. 4A, after playing piece 21*c* wins the challenge, then playing piece 20*b* is removed from the playing surface 10. If another playing piece (e.g., any one of 20*a*-20*f* in FIG. 3) moves into a recapture zone 12, then the player can select any playing piece that is removed from the playing surface 10 and place it back onto the playing surface 10. In one embodiment, the playing piece being reintroduced to the playing surface 10 has to have an equal or lesser numerical value then the playing piece that entered the recapture zone 12. In another embodiment, the playing piece being reintroduced to the playing surface 10 can have a less, equal, or greater numerical value then the playing piece that entered the recapture zone 12. In one embodiment, playing pieces with a value of one or two can only recapture lost/captured playing pieces. Further, and in embodiments where there are multiple recapture zones 12 on a playing surface 10, the recapture zones can be assigned to a given player. For instance, and referring to FIG. 4A, the recapture zone 12 of R1 and C1-C8 can be assigned to playing piece 21*c*, whereas the recapture zone 12 of R8 and C1-C8 can be assigned to playing piece 20*b*. In this way, and referencing FIG. 3, playing pieces 21*a*-21*f* can defend playing pieces 20*a*-20*f* from entering recapture zone 12 of R8 and C1-C8, and playing pieces 20*a*-20*f* can defend playing pieces 21*a*-21*f* from entering recapture zone 12 of R1 and C1-C8.

Figure 4A:
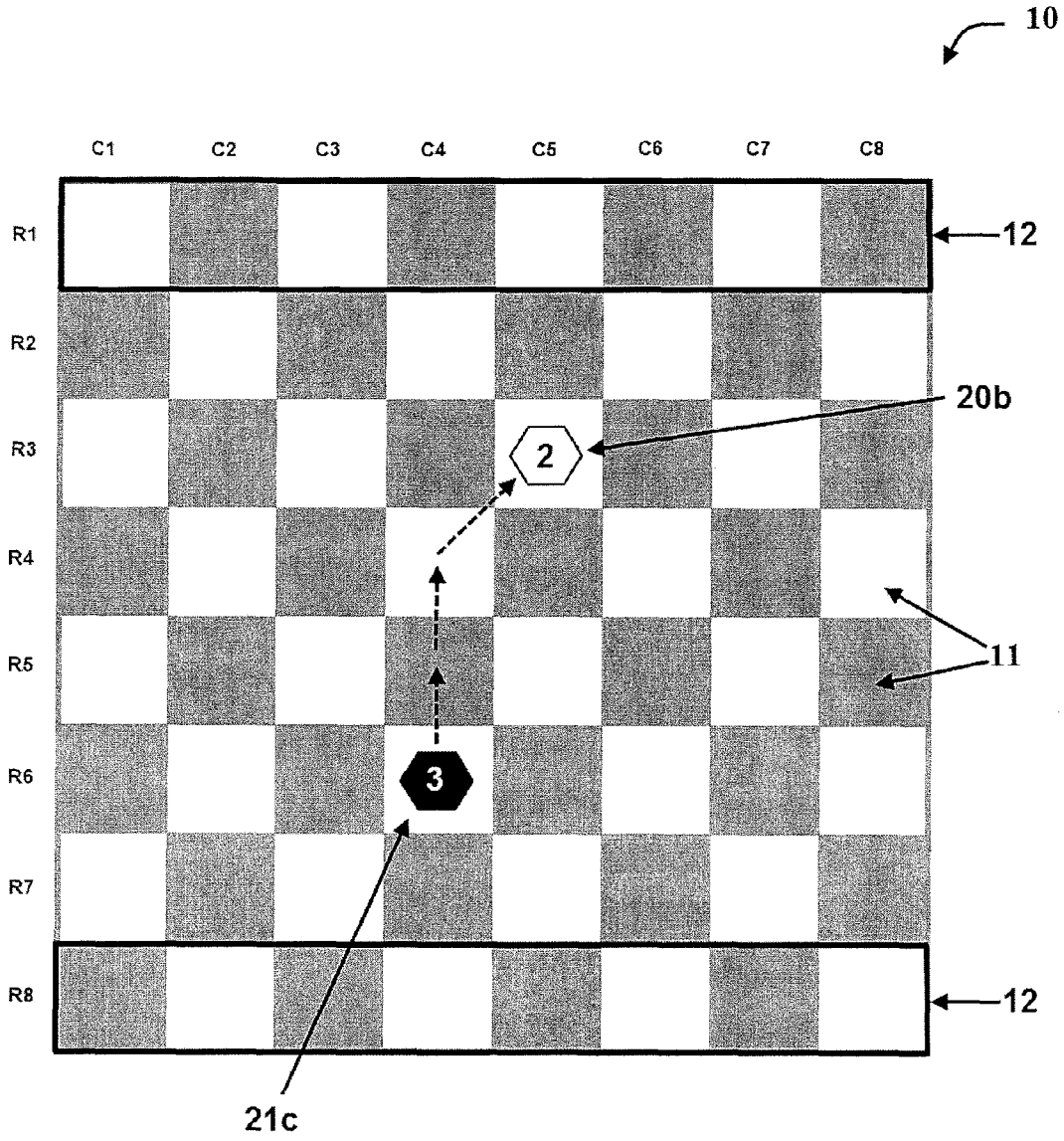
FIGS. 4A-4E illustrate challenges between two playing pieces.
Figure 4B:
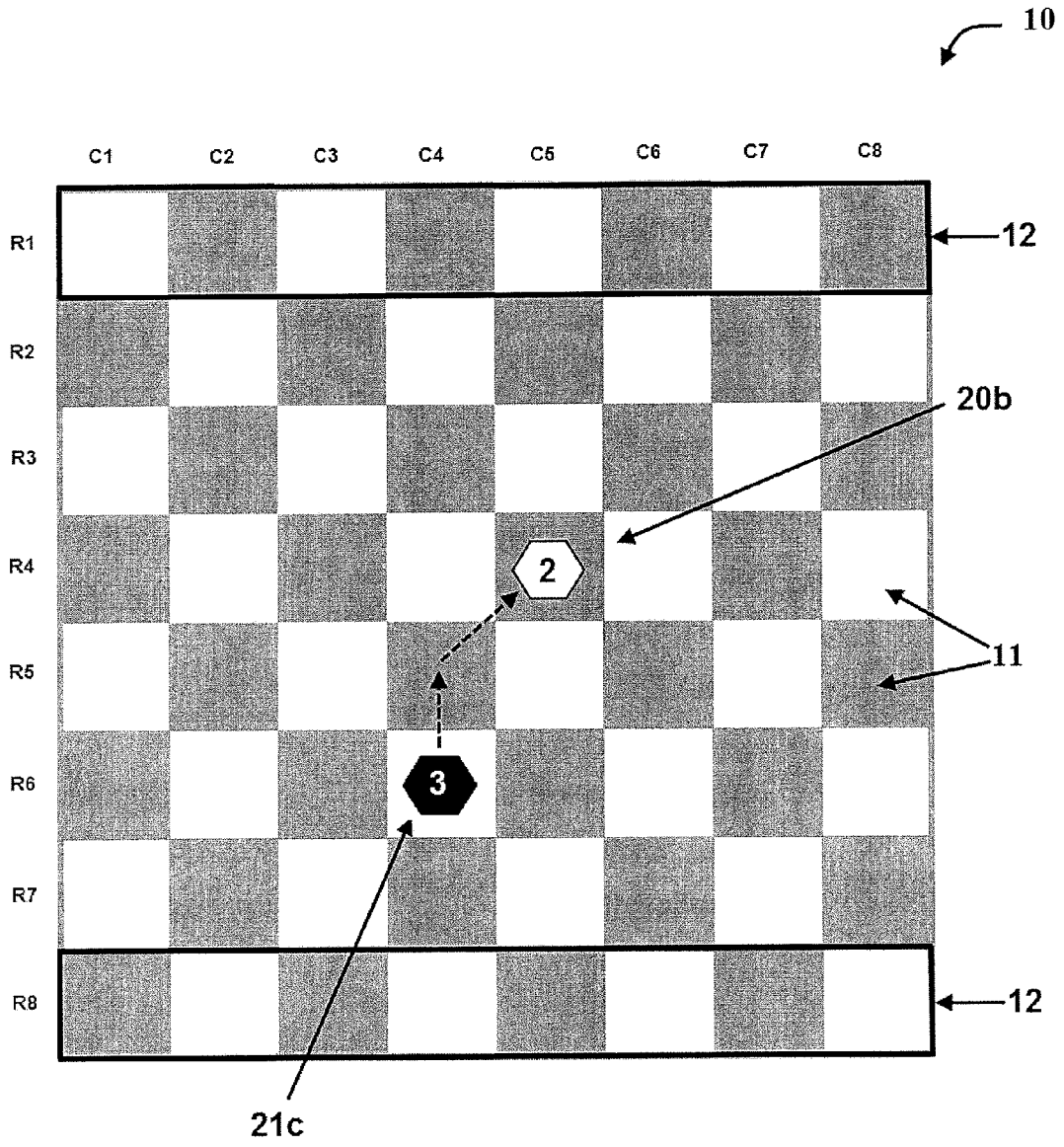
Figure 4C:
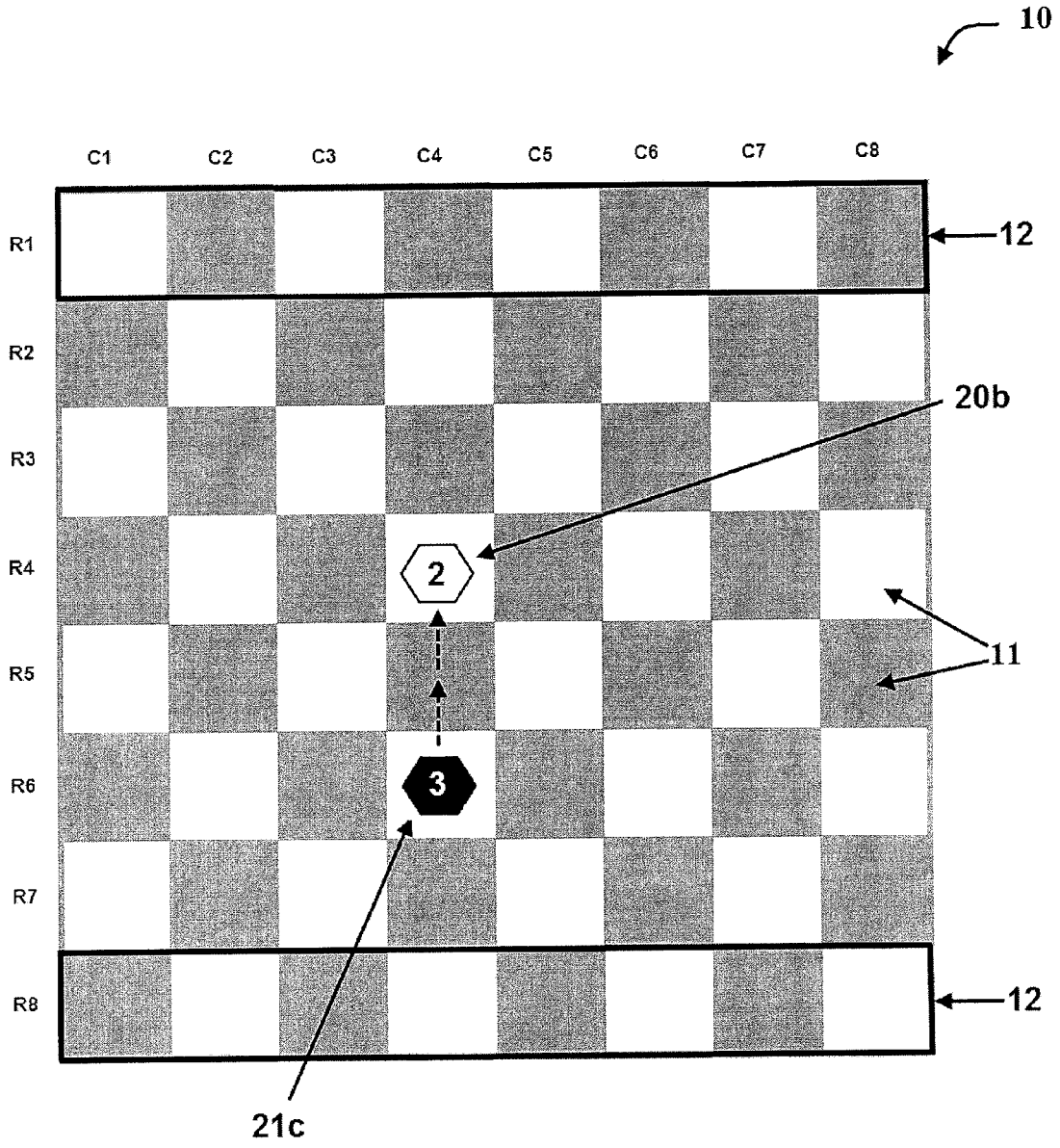
Figure 4D:
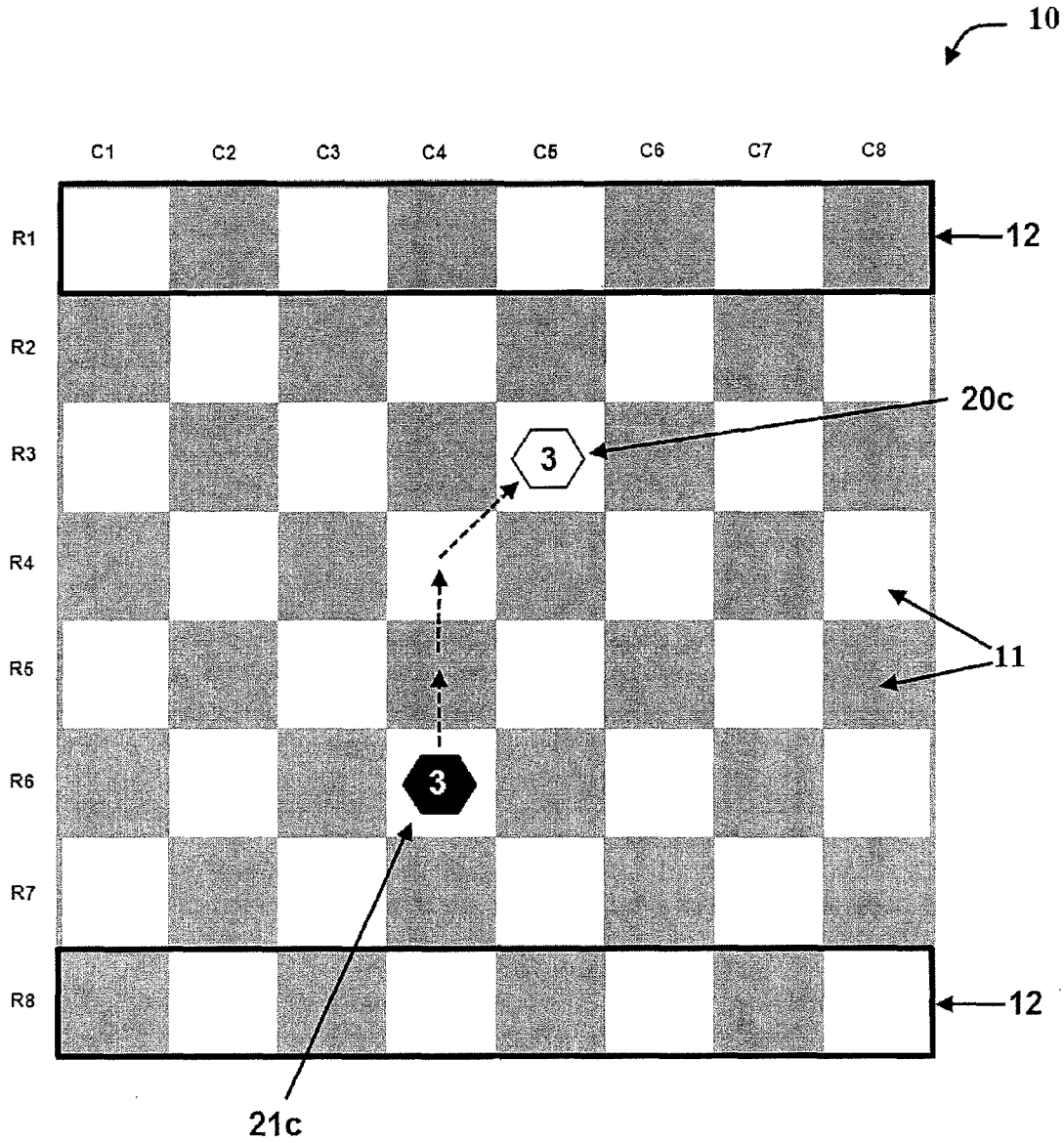

FIGS. 4B-4D provide additional illustrations of possible movements of the playing pieces and provoking challenges between playing pieces. For instance, FIG. 4B illustrates playing piece 21*c* moving and provoking a challenge with playing piece 20*b* in two moves. In some embodiments, after a challenge has been provoked, then the playing piece will forgo any further movement for this turn. For instance, although playing piece 21*c* in FIG. 4B only moved two spaces to provoke the challenge with playing piece 20*b*, it will forgo its right to move a third playing space 11. In other embodiments, however, and after a challenge has been provoked, then the playing piece could continue moving if it still has any movement value remaining after provoking the challenge (e.g., playing piece 21*c* in FIG. 4B could move an additional playing space 11 after provoking and winning the challenge between playing piece 20*b*).

FIG. 4C illustrates a challenge between playing piece 21*c* and 20*b*. In this embodiment, the challenge is invoked by vertically moving playing piece 21*c* into the playing space 11 of playing piece 20*b*. In other embodiments, however, a challenge could be invoked by moving either horizontally or vertically into another playing space of a playing piece. In some aspects, a challenge could be limited to only vertical movement into another playing space of a playing piece.

Figure 4E:
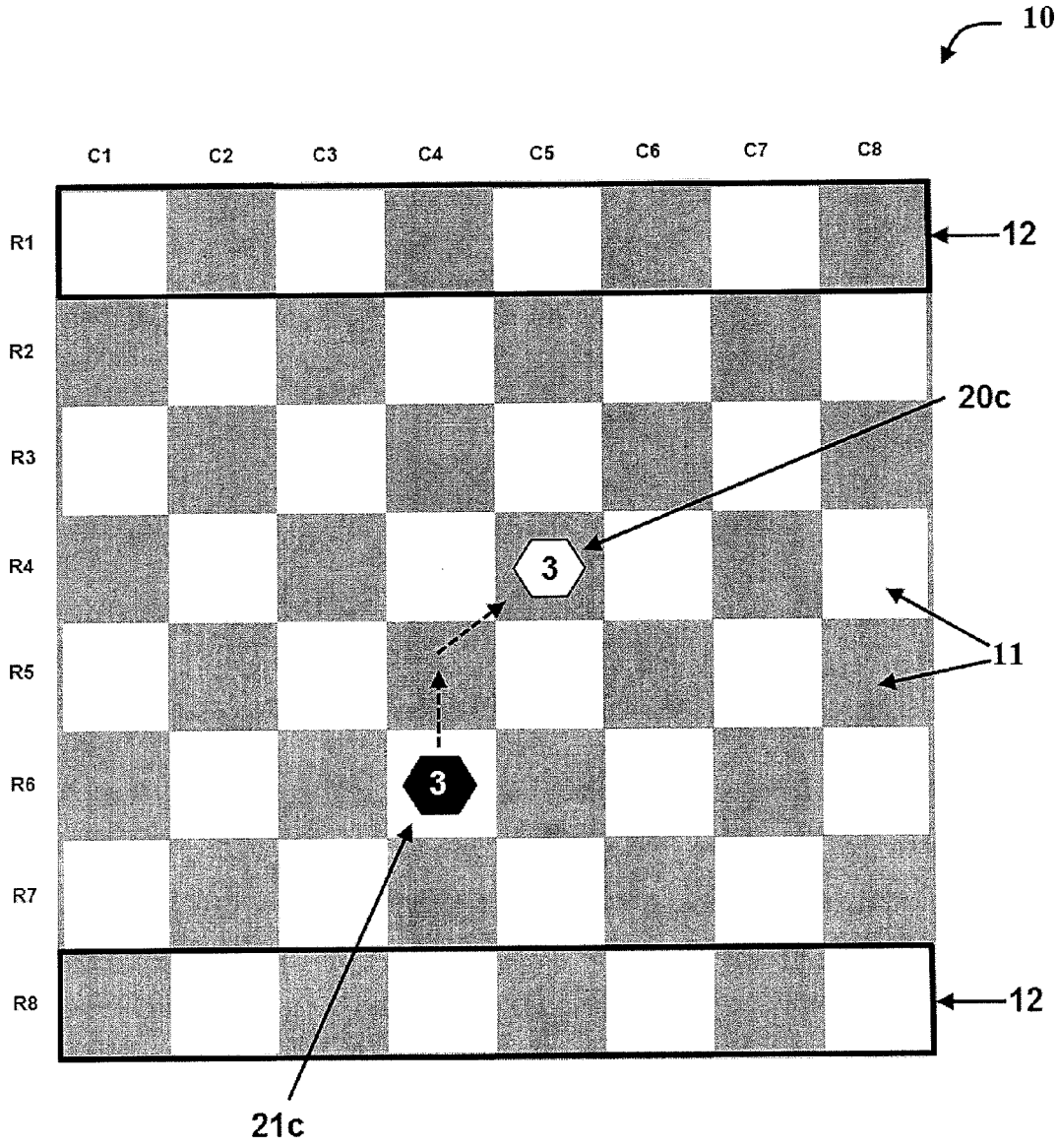

FIGS. 4D-E illustrate situations where a challenge is invoked by playing pieces 21*c* and 20*c* that have the same assigned numerical values. As noted previously, and in such instances, both pieces could be removed from the playing surface 10. Alternatively, the piece provoking the challenge could win; in this regard, a tie goes to the challenger. Alternatively, the piece provoking the challenge could lose; in this regard, a tie goes to the challengee.

In one embodiment, the first player to capture all of the opponents playing pieces wins the game.

E. Stacking

Figure 5A:
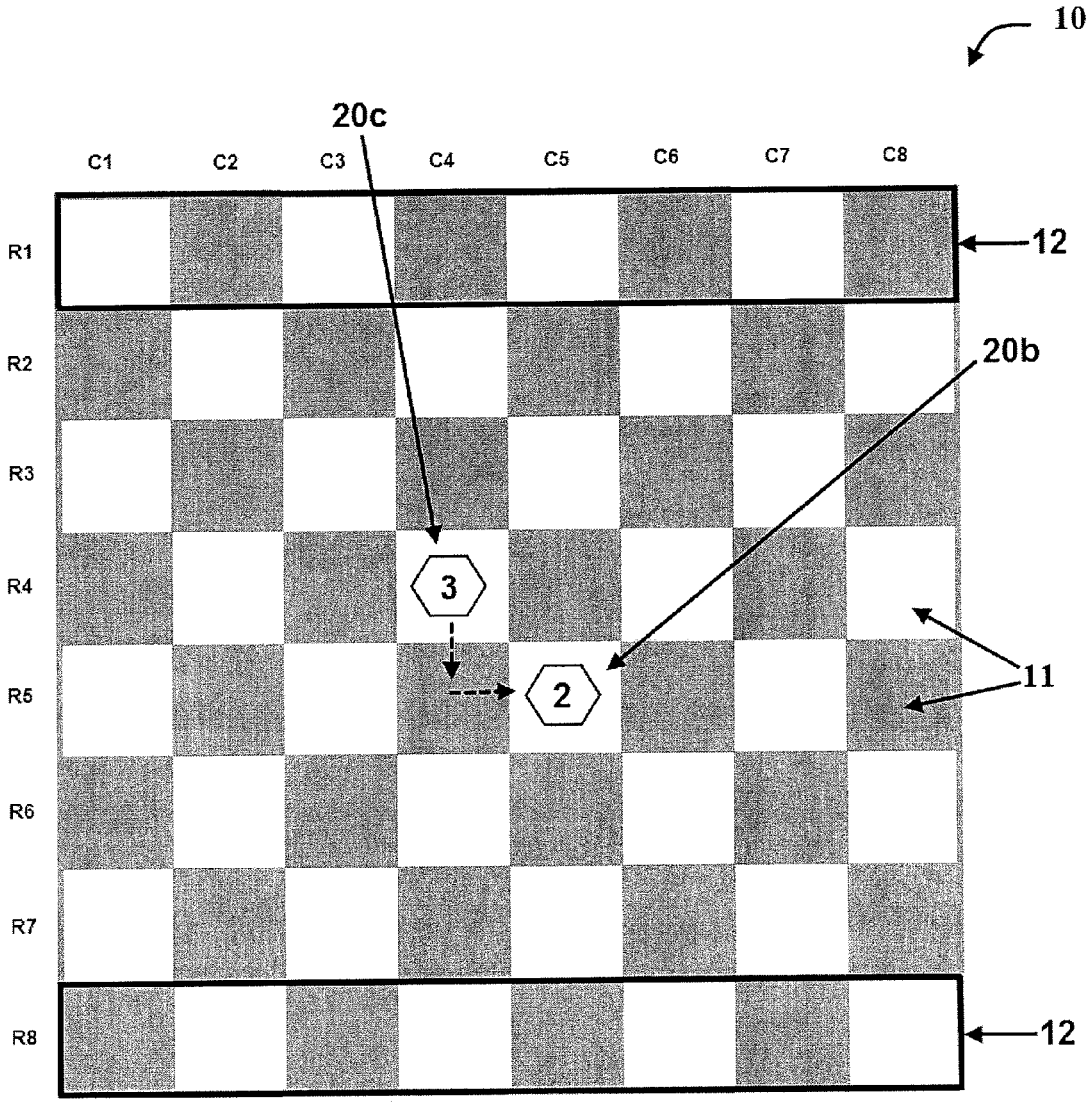
FIGS. 5A-5B illustrate stacking between two playing pieces.

FIG. 5A illustrates the concept of stacking playing pieces. In particular, playing piece 20*c* can move into the playing space 11 of playing piece 20*b* and be stacked on top of playing piece 20*b*. In other instances, playing piece 20*b* can be stacked on top of playing piece 20*c*. In some embodiments, after a stacking has occurred, then no further movement will occur for this turn.

Figure 5B:
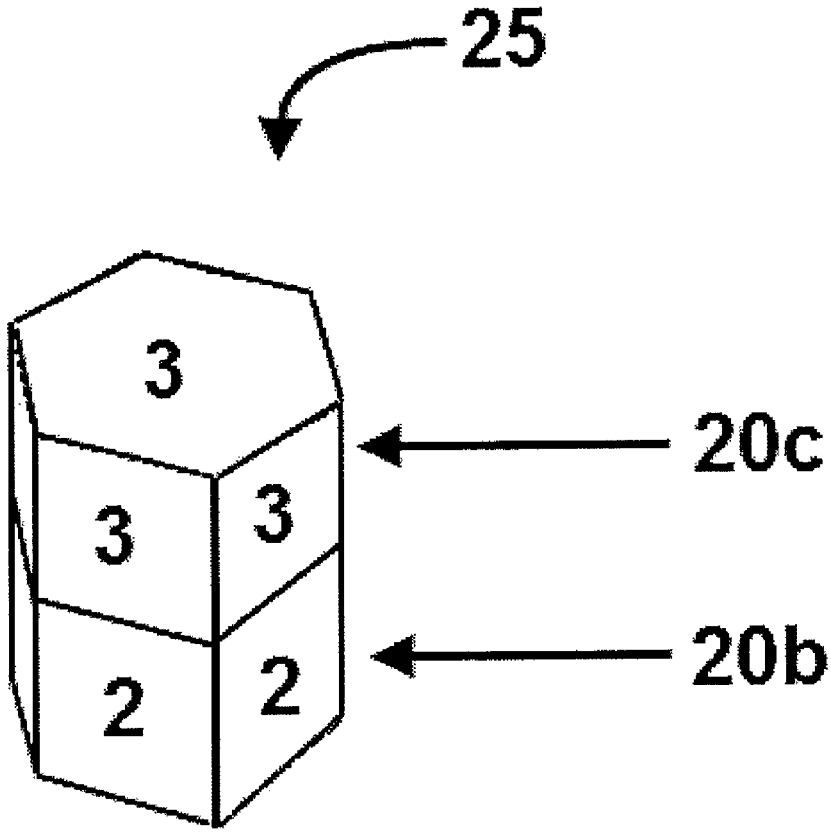

FIG. 5B illustrates a stacked piece 25. Stacked piece 25 can have both a movement value and a challenge value that is equal to the combined stack of pieces 20*c* and 20*b* (e.g., 5 and 5, respectively in FIG. 5A). Alternatively, stacked piece 25 can have a movement value that is equal to the movement value of the top piece 20*c* (e.g., 3) and a challenge value that is equal to the combined stack of pieces 20*c* and 20*b* (e.g., 5). Alternatively, stacked piece 25 can have a movement value that is equal to the combined stack of pieces 20*c* and 20*b* (e.g., 5) and a challenge value that is equal to the top piece 20*c* (e.g., 3).

Stacked piece 25 can also be unstacked. In one embodiment, unstacking can be performed in a recapture Zone 12. In another embodiment, unstacking can be performed any where on the playing surface 10.

F. Chains

FIGS. 6A-6E illustrate the concept of moving and challenging by using chains. In one embodiment, a chain can include at least two playing pieces from one player that occupy adjacent (whether horizontal, vertical, or diagonal) playing spaces 11. For instance, and with reference to FIG. 6A, the playing pieces spanning playing spaces R4-C2 to R3-C2 to R3-C4 illustrate a chain of playing pieces 30 (curved line represents the shape of the chain).

Figure 6A:
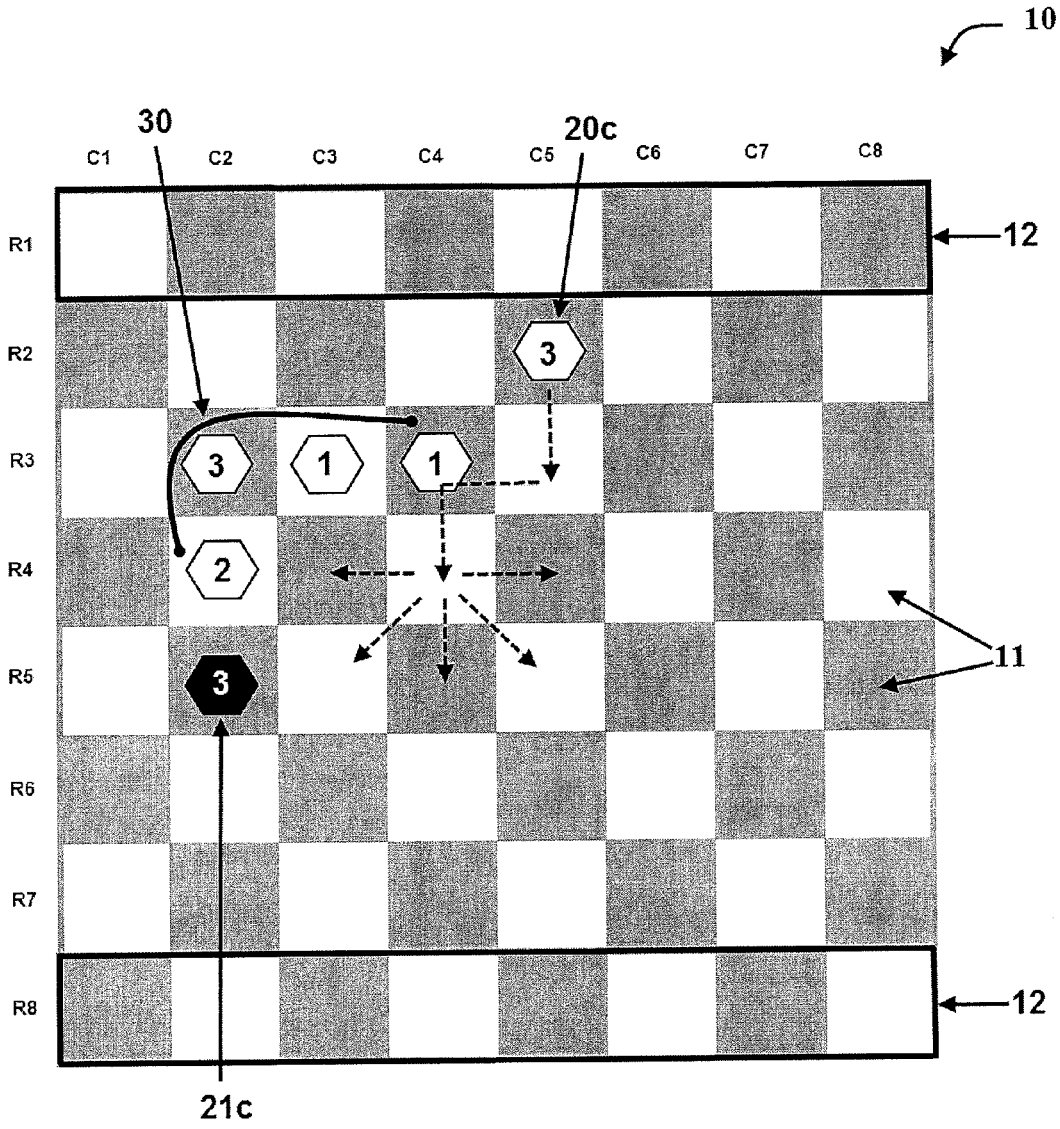
FIGS. 6A-6H illustrate movement and challenges with a chain of playing pieces.

A playing piece that enters a chain 30 can move along and exit or stop on any part of the chain 30, which results in a total movement of one playing space 11 with respect to the playing piece's corresponding movement value. For instance, and with reference to FIG. 6A. Playing piece 20*c*, which has a movement value of 3, can be moved from R2-C5 to R3-C5 (i.e., one space move) and then from R3-C5 to R3-C4, thereby entering the chain 30. Once entering the chain 30, playing piece 20*c* can slide along and exit any portion of the chain 30 (i.e., one playing space move). FIG. 6A represents playing piece 20*c* entering the chain and exiting from R3-C4 to R4-C4. The arrows from R4-C4 illustrate playing piece 20*c* has an additional move remaining (i.e., movement value of 3, with the first move being from R2-C5 to R3-C5; the second move being from R3-C5 to R3-C4, thereby entering the chain and subsequently exiting the chain at R4-C4; and the third move being from R4-C4 to either one of R4-C3, R5-C3, R5-C4, R5-C5, R4-C5).

Figure 6B:
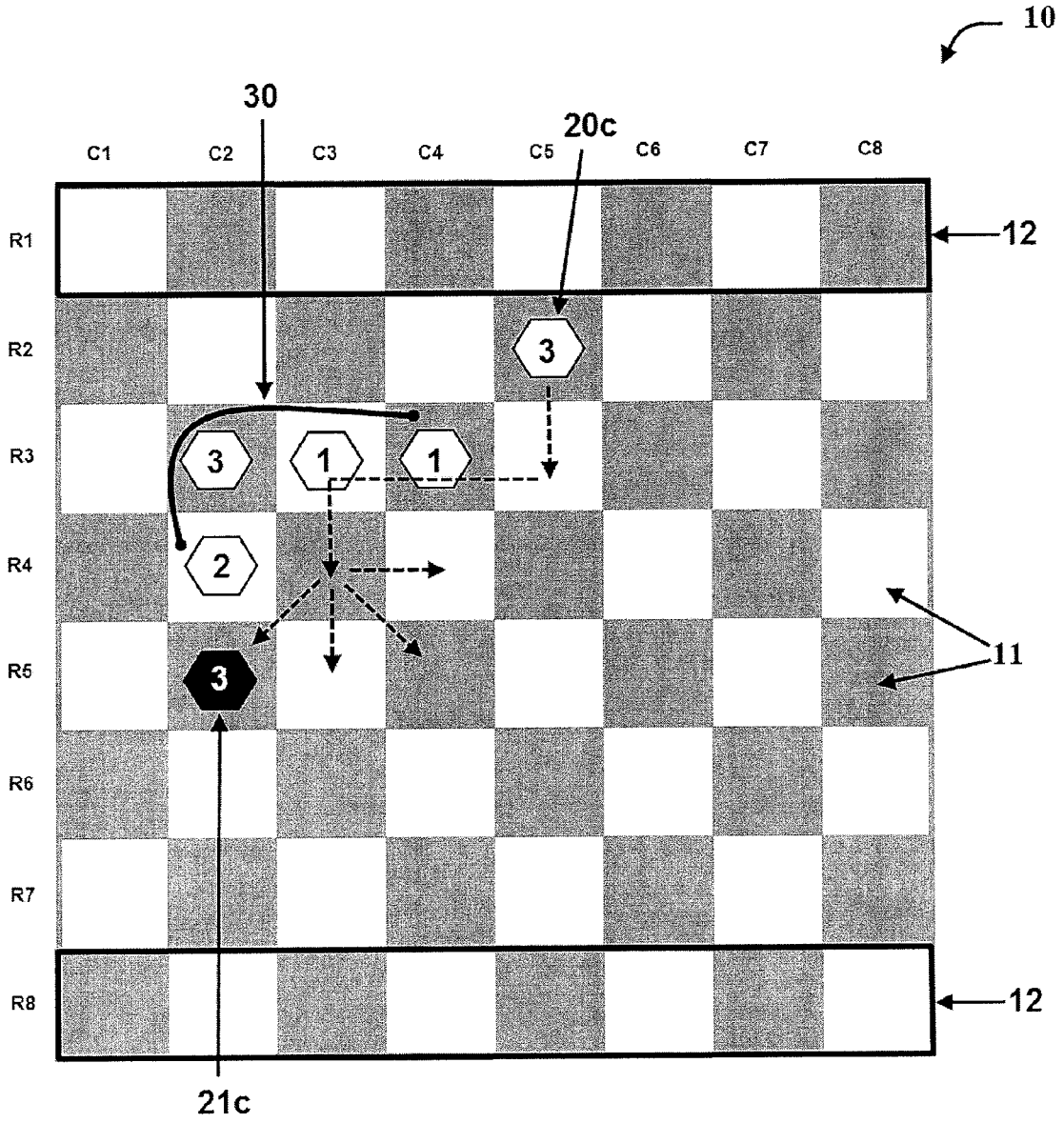

FIG. 6B represents playing piece 20*c* entering the chain 30 and exiting from R3-C3 to R4-C3. The arrows from R4-C3 illustrate playing piece 20*c* has an additional move remaining.

Figure 6C:
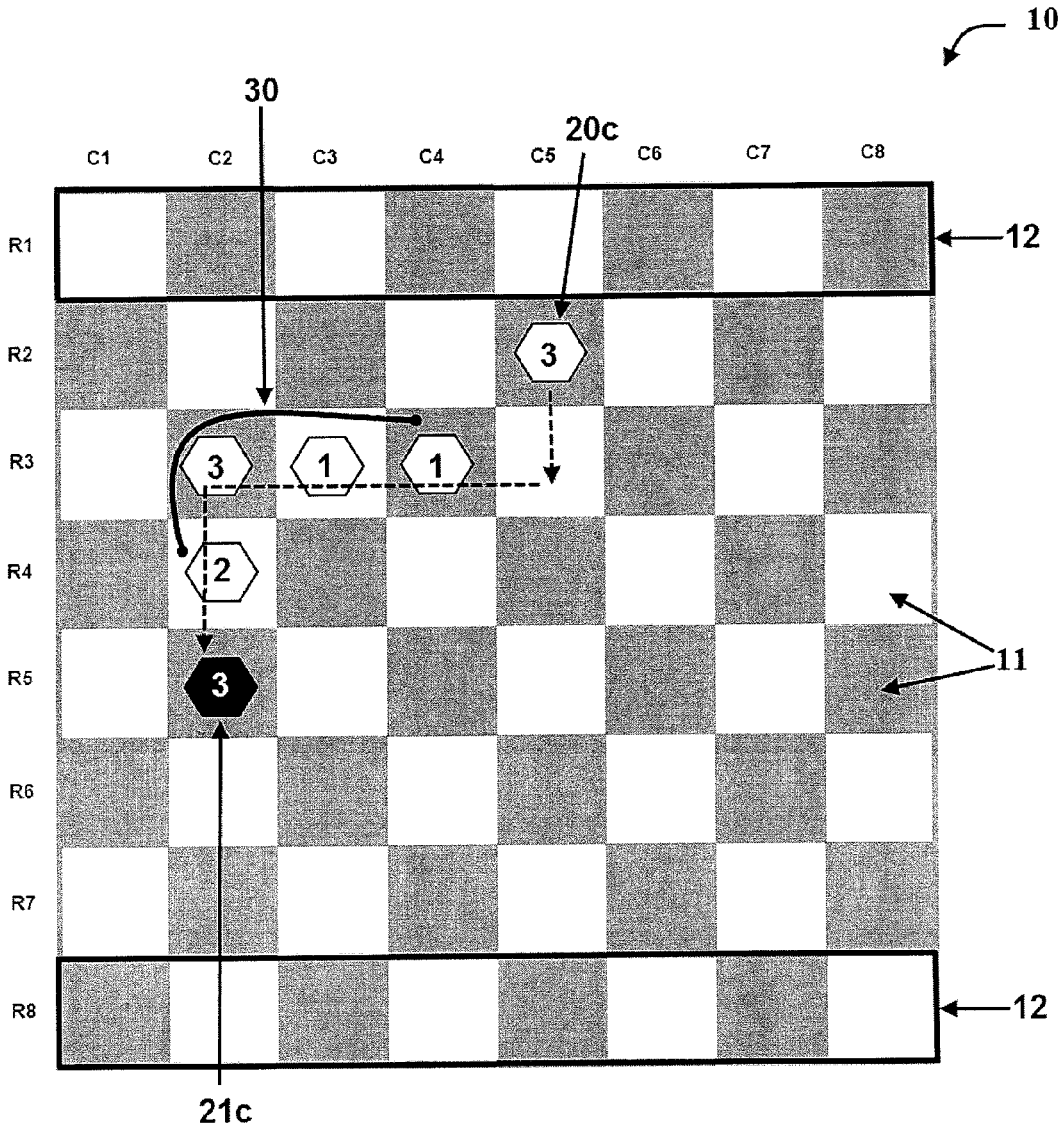

FIG. 6C represents playing piece 20*c* entering the chain 30 and exiting from R4-C2 to R5-C2. By exiting the chain 30 at R5-C2, a challenge is provoked between playing piece 20*c* and playing piece 21*c*. In one embodiment, when a challenge is provoked immediately after exiting either end or any point along the chain 30 (e.g., playing piece 20*c*'s move into R5-C2), the playing piece exiting the chain (e.g., playing piece 20*c*) has a challenge value equal to the total value of the chain 30 (e.g., 7 in FIG. 6C). In some instances, the challenge value is equal to the total value of the chain 30 (e.g., 7 in FIG. 6C) plus the value of the challenging playing piece (e.g., 10 in FIG. 6C). In other instances, the challenge value is simply the value of the challenging playing piece (e.g., 3 in FIG. 6C).

Figure 6D:
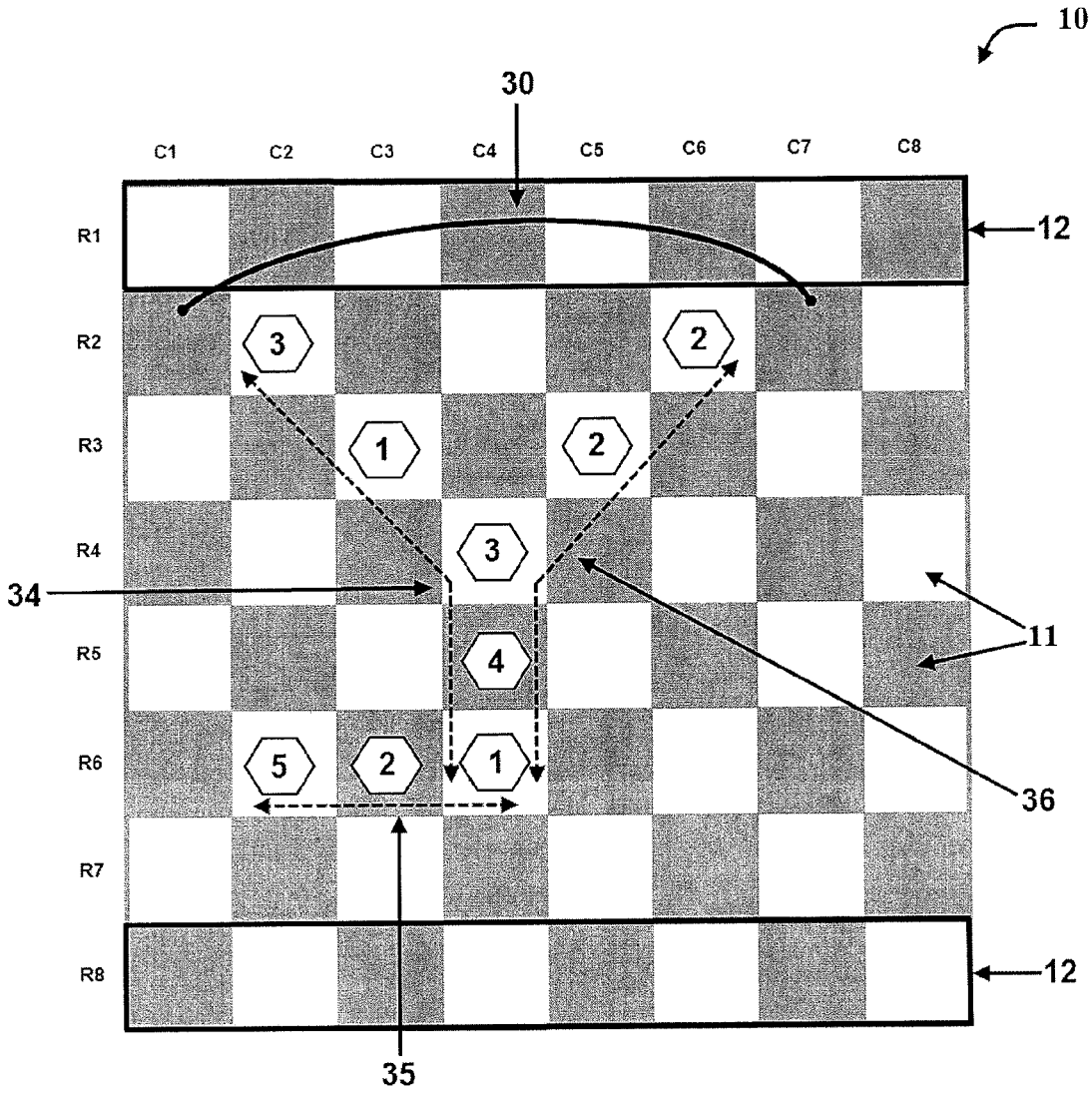

FIG. 6D provides additional non-limiting representations on the variety of ways to calculate a chain's value for challenge purposes. In one instance, and as discussed in the above paragraph, the entire value of the chain 30 can be used for challenge purposes. In such an embodiment, the challenge value of the chain 30 in FIG. 6D would be 23. In other embodiments, the challenge value of the chain 30 can be limited to adjacent playing pieces that are aligned in a general direction. By way of example, and in instances where a challenge is invoked between a playing piece exiting the chain 30 at R6,C1, the challenge value of the chain 30 is limited to 8, as the adjacent playing pieces occupying R6,C2, R6,C3, and R6,C4 are all moving along a general horizontal direction. This is illustrated by the broken arrow 35. Similarly, in instances where a challenge is invoked between a playing piece exiting the chain 30 at R7,C4, the challenge value of the chain 30 is limited to 16, as the adjacent playing pieces occupying R6,C4, R5,C4, R4,C4, R3,C3, R2,C2, R3,C5, and R2,C6 are all moving along a general vertical direction. This is illustrated by broken arrows 34 and 36. In instances where a challenge is invoked between a playing piece exiting the chain 30 at R1,C1, the challenge value of the chain 30 is limited to 12, as the adjacent playing pieces occupying R2,C2, R3,C3, R4,C4, R5,C4, and R6,C4 are all moving along a general vertical direction. This is illustrated by broken arrow 34.

Figure 6E:
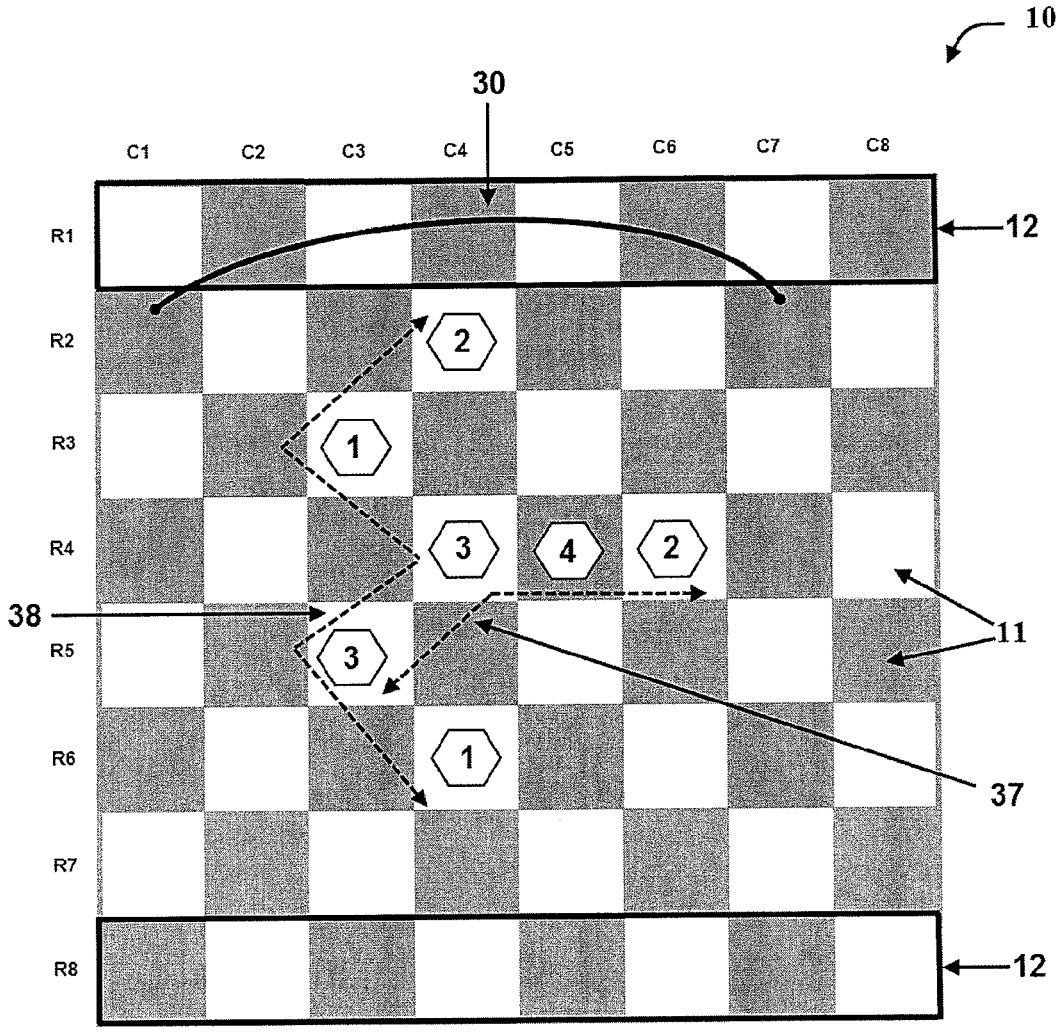

FIG. 6E provides a further illustration of a chain's value for challenge purposes. Broken arrows 37 and 38 illustrate the challenge value of the chain 30 for adjacent playing pieces moving in a generally horizontal direction 37 and in a generally vertical direction 38. For example, in instances where a challenge is invoked between a playing piece exiting the chain 30 at R7,C5, the challenge value of the chain 30 is limited to 10, as the adjacent playing pieces occupying R6,C4, R5,C3, R4,C4, R3,C3, and R2,C4 are all moving along a general vertical direction. This is illustrated by broken arrow 38. In instances where a challenge is invoked between a playing piece exiting the chain 30 at R4,C7, the challenge value of the chain 30 is limited to 12, as the adjacent playing pieces occupying R5,C3, R4,C4, R4,C5, and R4,C6 are all moving along a general horizontal direction. This is illustrated by broken arrow 37.

Figure 6F:
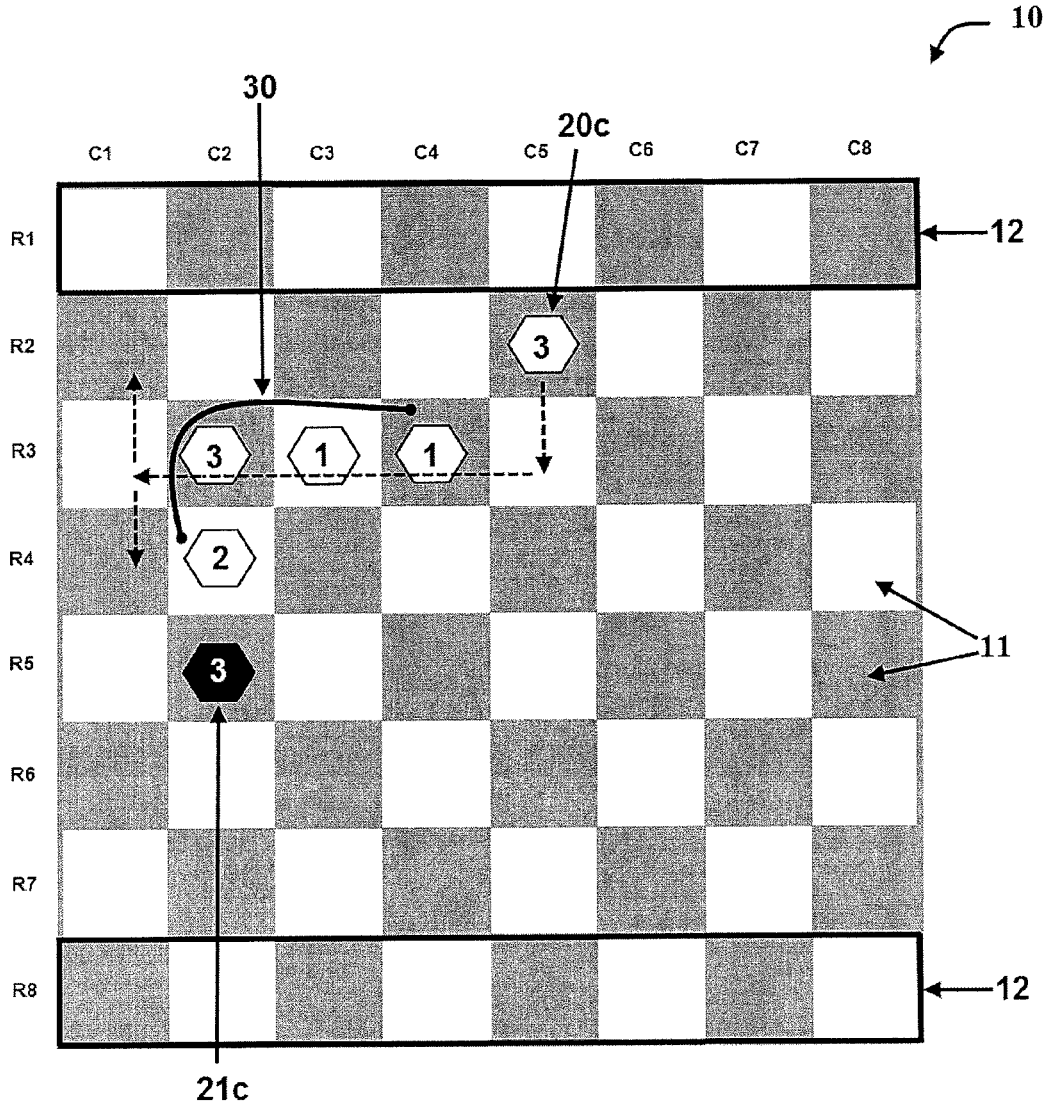

FIG. 6F represents playing piece 20*c* entering the chain 30 and exiting from R3-C2 to R3-C1. The arrows from R3-C1 illustrate playing piece 20*c* has an additional move remaining.

Figure 6G:
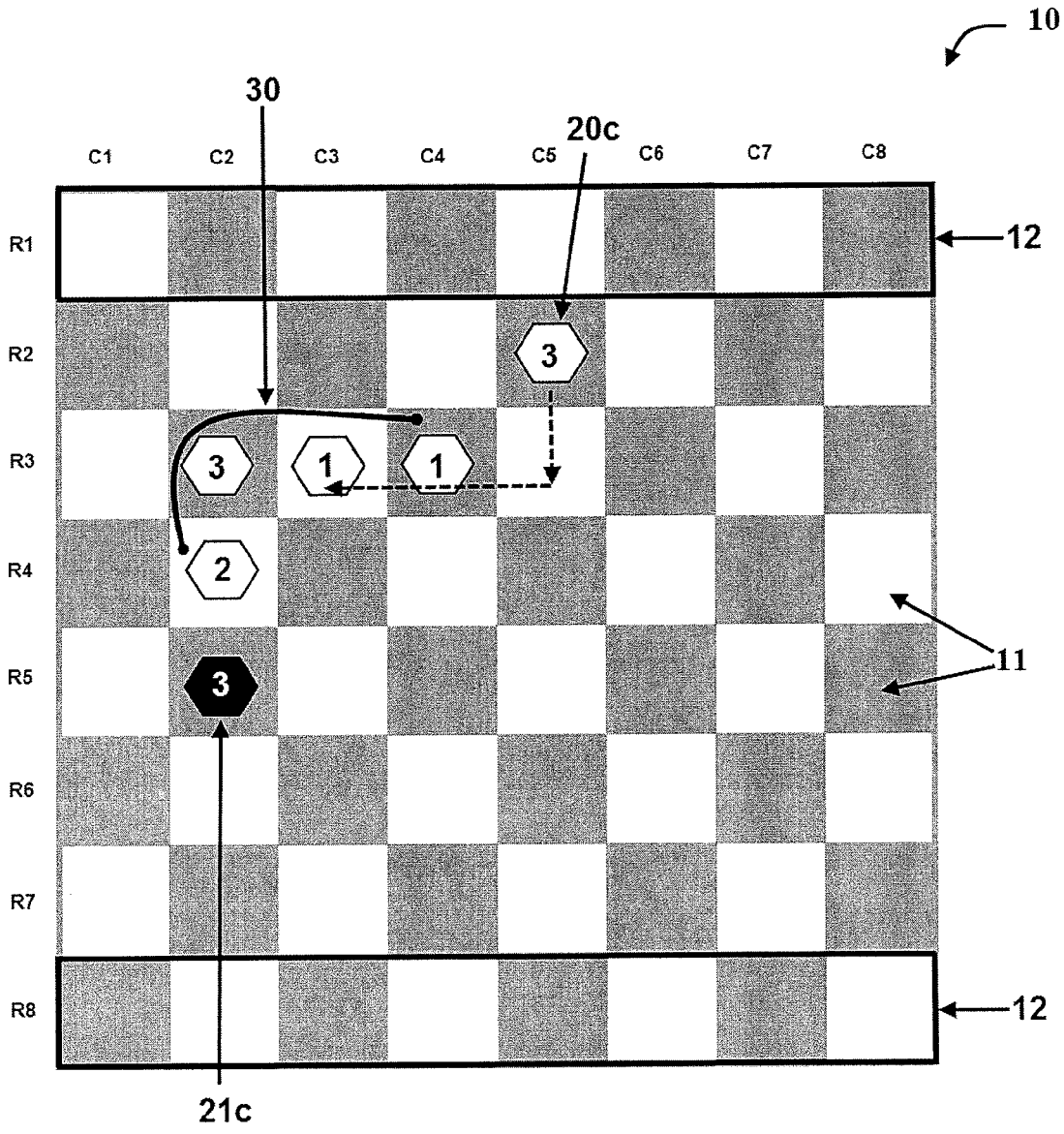

In particular embodiments, a playing piece entering a chain can move along and stop along any point of the chain, thereby creating a stack. This concept is illustrated in FIG. 6G, where playing piece 20*c* enters the chain 30 and stops at playing space R3,C3, thereby creating a stack of playing pieces within the chain 30.

Figure 6H:
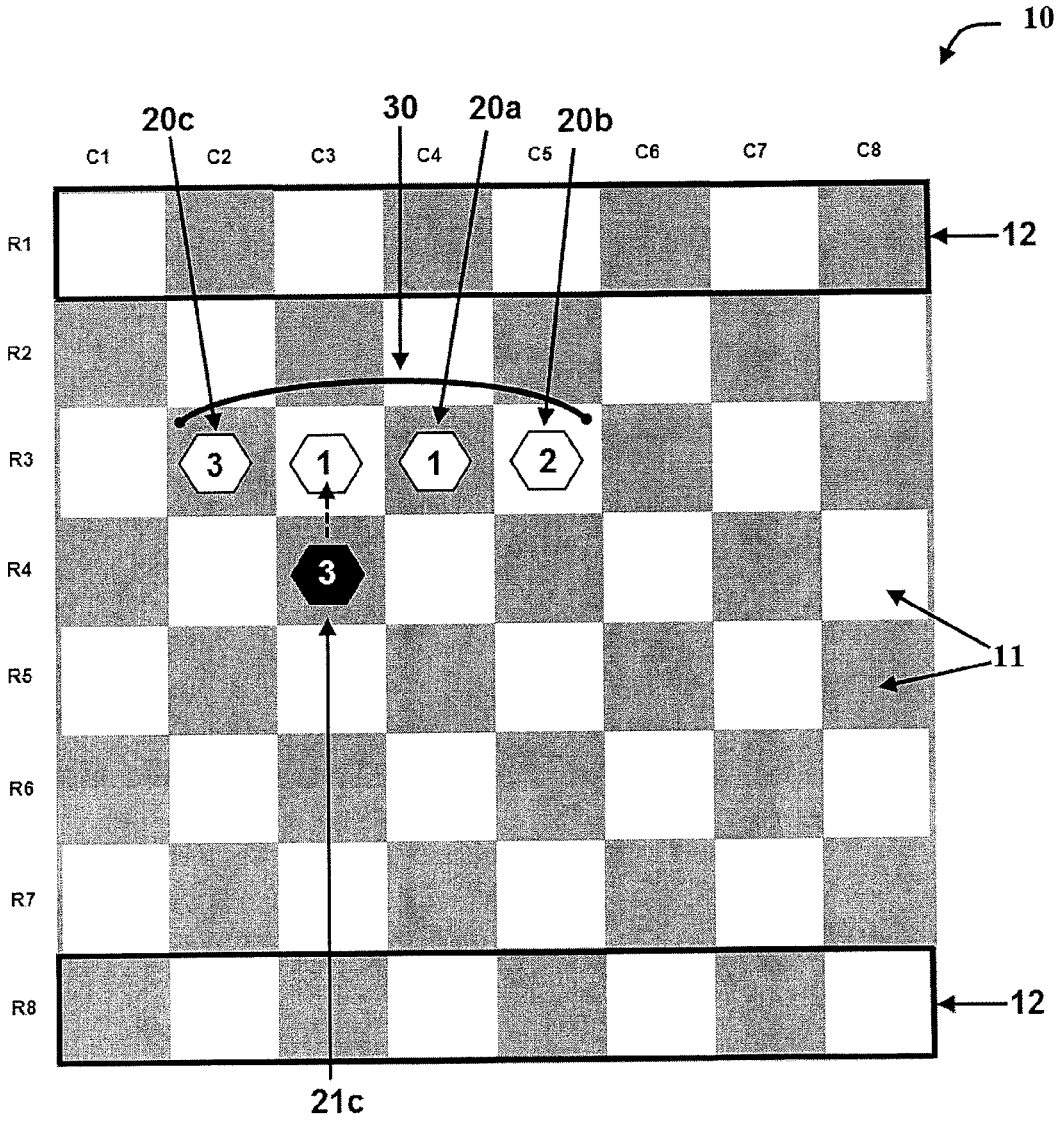

Referring to FIG. 6H, in certain embodiments, a player can attack a chain the middle of the chain. Playing piece 21C attacked the chain 30 in the middle be moving into playing space R3, C3, thereby initiating a challenge. In such an instance, the challenge value of the chain being attacked is limited to the challenge of the individual piece (i.e., one in the instance illustrated in FIG. 6H). In a subsequent move, the opposing player has an option to counterattack playing piece 21*c* by either moving playing piece 20*c*, 20*a*, or 20*b* into playing space R3,C3. If playing piece 20*c* is moved in such a manner, then a chain 30 would be created between playing pieces 20*c*, 20*a*, and 20*b*, and the total challenge value of the chain 30 is used (in this instance, six). If playing piece 20*a* is moved in such a manner, then a chain between 20*c* and 20*a* would be created, and the total challenge value of the chain 30 is used (in this instance four). If playing piece 20*b* is moved in such a manner, then a chain between playing pieces 20*c*, 20*a*, and 20*b* would be created, and the total challenge value of the chain 30 is used (in this instance six).

Still referring to FIG. 6H, and in certain embodiments, playing piece 21*c* could choose to initiate a challenge between playing piece 20*b* via moving to playing spaces R4,C4, and R4,C5, and then R3,C5. By attacking the chain 30 at one of its ends rather than in the middle, the full value of the chain 30 is used for challenge purposes. Therefore, playing piece 21*c* would lose a challenge by attaching playing piece 20*b* (or for that matter playing piece 20*c*) due to the challenge value of playing piece 21*c* being three, whereas the challenge value of the chain 30 is seven.

G. Computer Related Applications

In further embodiments, the board game described herein can be played on a computer and can be stored or accessed on/from a computer readable medium. In certain aspects, the board game includes: a computer having data input means for inputting data indicative of a player's intention to cause movement of a playing piece on a game board; a processor associated with the computer for processing the input data in accordance with preprogrammed parameters to determine the status of one or more playing pieces on the game board; and output display means for displaying the playing pieces on a playing surface. In certain instances, programs can be included in the computer to allow a user to play against a second user or to allow a user to play against a computer program. Any standard computer and programming techniques can be used to write a program that can be used to play the game board disclosed herein.

The above text describes non-limiting examples of various embodiments of the invention.

The invention claimed is:

1. A method of playing a board game on a computer with a plurality of players comprising:

providing a computer which displays a playing surface having a plurality of playing spaces and a plurality of playing pieces that comprise at least first and second player playing pieces, wherein each playing piece is assigned a numerical value, and wherein the numerical value corresponds to:

(i) a movement value, wherein the movement value corresponds to the number of playing spaces that each playing piece can move on the playing surface; and (ii) a challenge value, wherein the challenge value corresponds to a challenge between a first player playing piece and a second player playing piece, wherein the second player playing piece can be removed from the playing surface when the first player playing piece has an equal or greater challenge value then the second player playing piece and when the first player playing piece is moved into the second player playing piece's playing space, wherein a processor associated with the computer receives and processes data inputted by a player into the computer, wherein the data is indicative of the player's intention to cause movement of the player playing pieces on the playing surface in accordance with the movement and challenge values of the playing pieces, wherein the plurality of playing pieces can be stacked on top of one another during the game, wherein the movement value of the stacked playing pieces is the assigned numerical value of the top pieces of the stack and the challenge value of the stacked playing pieces is the combined assigned numerical value of all of the playing pieces in the stack, and wherein a first player playing piece can move along a chain of playing pieces that is present on the playing surface, wherein the chain comprises at least two other first player playing pieces that occupy adjacent playing spaces, wherein the chain comprises a challenge value, wherein the challenge value is the combined value of all of the playing pieces that comprise the chain, and wherein the first player playing piece can be removed along any point of the chain by moving to: (i) an unoccupied playing space that is adjacent to the chain; (ii) a playing space that is adjacent to the chain and occupied by another first player playing piece; (iii) a playing space that is adjacent to the chain and occupied by a second player playing piece; or (iv) any point along the chain to create a stack of playing pieces.

2. The method of claim 1, wherein the board game is stored on or accessed from a computer readable medium.

3. The method of claim 1, wherein the first player playing pieces comprise:

four playing pieces having an assigned numerical value of one;

two playing pieces having an assigned numerical value of two;

two playing pieces having an assigned numerical, value of three;

two playing pieces having an assigned numerical value of four;

one playing piece having an assigned numerical value of five; and one playing pieces having an assigned numerical value of six, wherein the second player playing pieces comprise:

four playing pieces having an assigned numerical value of one;

two playing pieces having an assigned numerical value of two;

two playing pieces having an assigned numerical value of three;

two playing pieces having an assigned numerical value of four;

one playing piece having an assigned numerical value of five; and one playing pieces having an assigned numerical value of six, wherein the assigned numerical values are visible on the first and second player playing pieces.

4. The method of claim 1, wherein all of the playing pieces on the playing surfaces having movement and challenge values and all are capable of, moving horizontally and vertically along any of the playing spaces up to their respective assigned numerical values.

* * * * *